US010998623B2

(12) United States Patent
Runyon et al.

(10) Patent No.: US 10,998,623 B2
(45) Date of Patent: May 4, 2021

(54) METHOD AND APPARATUS FOR BEAM-STEERABLE ANTENNA WITH SINGLE-DRIVE MECHANISM

(71) Applicant: Viasat, Inc., Carlsbad, CA (US)

(72) Inventors: Donald L. Runyon, Duluth, GA (US); Edward Mitchell Blalock, Doraville, GA (US)

(73) Assignee: Viasat, Inc., Carlsbad, CA (US)

( * ) Notice: Subject to any disclaimer, the term of this patent is extended or adjusted under 35 U.S.C. 154(b) by 5 days.

(21) Appl. No.: 16/598,672

(22) Filed: Oct. 10, 2019

(65) Prior Publication Data

US 2020/0119441 A1 Apr. 16, 2020

Related U.S. Application Data

(63) Continuation of application No. 15/960,276, filed on Apr. 23, 2018, now Pat. No. 10,483,637, which is a (Continued)

(51) Int. Cl.
*H01Q 3/08* (2006.01)
*H01Q 3/00* (2006.01)
(Continued)

(52) U.S. Cl.
CPC ..... *H01Q 3/005* (2013.01); *H01Q 1/125* (2013.01); *H01Q 3/04* (2013.01); *H01Q 3/06* (2013.01); *H01Q 3/08* (2013.01); *H01Q 15/14* (2013.01)

(58) Field of Classification Search
CPC ..... H01Q 3/005; H01Q 3/04; H01Q 3/06; H01Q 3/08; H01Q 1/125; H01Q 15/14
See application file for complete search history.

(56) References Cited

U.S. PATENT DOCUMENTS 2,405,305 A 9/1946 Langstroth et al.
2,407,310 A 9/1946 Lundy et al.
(Continued)

FOREIGN PATENT DOCUMENTS

CN 103794884 A 5/2014
CN 103904430 A 7/2014
GB 670631 4/1952

OTHER PUBLICATIONS

Brooker, "Antenna Pointing Accuracy Impact on Geostationary Satellite Link Quality and Interference", Proceedings of the 23rd AIAA International Communications Satellite Systems and 11th Ka and Broadband Communications Joint Conference, 2005, 11 pgs.
(Continued)

*Primary Examiner* — Hoang V Nguyen
(74) *Attorney, Agent, or Firm* — Holland & Hart LLP

(57) ABSTRACT

In one embodiment, an antenna assembly is described. The antenna assembly includes an antenna and an antenna positioner coupled to the antenna. The antenna positioner includes a single drive interface and a plurality of gears. The plurality rotate in a first manner in response to a first drive direction applied through the single drive interface, and rotate in a second manner in response to a second drive applied through the single drive interface. The antenna positioner also includes a threaded rod that moves in a first rod direction and a second rod direction in response to rotation of the plurality of gears in the first manner and the second manner respectively. The antenna positioner also includes a tilt plate contacting the threaded rod. The tilt plate tilts about a pivot line in response to movement of the threaded rod to move a beam of the antenna in a spiral pattern.

19 Claims, 15 Drawing Sheets

Related U.S. Application Data continuation of application No. 15/231,584, filed on Aug. 8, 2016, now Pat. No. 9,979,082.

(60) Provisional application No. 62/203,324, filed on Aug. 10, 2015.

(51) Int. Cl.

| | |
|---|---|
| ***H01Q 3/04*** | (2006.01) |
| ***H01Q 15/14*** | (2006.01) |
| ***H01Q 1/12*** | (2006.01) |
| ***H01Q 3/06*** | (2006.01) |

(56) References Cited

U.S. PATENT DOCUMENTS

| | | | | |
|---|---|---|---|---|
| 2,410,827 | A | 11/1946 | Langstroth et al. | |
| 2,710,352 | A | 6/1955 | Getting et al. | |
| 3,541,561 | A | 11/1970 | Chubb, Jr. | |
| 3,848,255 | A | 11/1974 | Migdal | |
| 4,691,207 | A | 9/1987 | Timineri | |
| 4,772,892 | A | 9/1988 | Payelian et al. | |
| 5,194,874 | A | 3/1993 | Perrotta | |
| 5,929,808 | A | 7/1999 | Hassan et al. | |
| 5,999,139 | A | 12/1999 | Benjamin et al. | |
| 6,043,788 | A | 3/2000 | Seavey | |
| 6,204,823 | B1 * | 3/2001 | Spano | H01Q 1/125 343/705 |
| 6,262,689 | B1 | 7/2001 | Yamamoto et al. | |
| 6,313,805 | B1 | 11/2001 | Nishiyama | |
| 6,492,955 | B1 | 12/2002 | Amyotte et al. | |
| 6,747,604 | B2 | 6/2004 | Amyotte et al. | |
| 6,972,729 | B2 | 12/2005 | Wang | |
| 7,961,153 | B2 | 6/2011 | Haziza | |
| 8,068,053 | B1 | 11/2011 | Stutzke et al. | |
| 8,134,512 | B1 | 3/2012 | Chen et al. | |
| 8,487,813 | B2 | 7/2013 | Leiba et al. | |
| 8,982,004 | B1 | 3/2015 | Santoru et al. | |
| 9,979,082 | B2 | 5/2018 | Runyon et al. | |
| 2003/0043071 | A1 | 3/2003 | Lilly et al. | |
| 2007/0052604 | A1 * | 3/2007 | Young | H01Q 1/125 343/757 |
| 2007/0052607 | A1 * | 3/2007 | Dwornik | H01Q 3/08 343/766 |
| 2011/0095959 | A1 * | 4/2011 | Schertz | H01Q 19/12 343/884 |
| 2014/0028514 | A1 | 1/2014 | Chuchanski et al. | |
| 2014/0266897 | A1 | 9/2014 | Jakoby et al. | |
| 2014/0266901 | A1 | 9/2014 | Klemes | |
| 2017/0047653 | A1 | 2/2017 | Runyon et al. | |

OTHER PUBLICATIONS

Ehyaie, "Novel Approaches to the Design of Phased Array Antennas", The University of Michigan 2011, 153 pgs.

Gupta et al., "Beam Steerable Antenna Design for Directional MAC Layer for Next Generation Networks", International Journal of Electronics & Communication Technology, vol. 2, Issue 4, Oct.-Dec. 2011, 4 pgs.

Xu et al., "Report on steerable antenna architectures and critical RF circuits performance", FP6-IST-2003-506745 Capanina, Information Society Technologies, Nov. 20, 2006, 85 pgs.

* cited by examiner

METHOD AND APPARATUS FOR BEAM-STEERABLE ANTENNA WITH SINGLE-DRIVE MECHANISM

CROSS-REFERENCE TO RELATED APPLICATIONS

This application is a continuation of U.S. patent application Ser. No. 15/960,276 filed Apr. 23, 2018, entitled, "METHOD AND APPARATUS FOR BEAM-STEERABLE ANTENNA WITH SINGLE-DRIVE MECHANISM" which is a continuation of U.S. patent application Ser. No. 15/231,584, filed Aug. 8, 2016, entitled "METHOD AND APPARATUS FOR BEAM-STEERABLE ANTENNA WITH SINGLE-DRIVE MECHANISM", which claims priority to U.S. Provisional Application No. 62/203,324, titled "METHOD AND APPARATUS FOR BEAM-STEERABLE REFLECTOR ANTENNA WITH SINGLE-DRIVE MECHANISM", filed Aug. 10, 2015, each of which are incorporated by reference herein.

BACKGROUND

The present disclosure relates to communications systems, and more specifically to systems and methods for pointing an antenna.

A directional antenna is typically aligned upon deployment to the location the antenna is to be used. An installer may attach a support structure of the antenna to an object (e.g., ground, a building or other structure, etc.) and carry out a pointing process to point the beam of the antenna towards a target antenna (e.g., on a geostationary satellite, etc.). The pointing process may include loosening bolts on a mounting bracket on the back of the antenna and physically moving the antenna until sufficiently pointed at the target using a signal metric (e.g., signal strength) of a signal communicated between the antenna and the target. Once sufficiently pointed, the installer may tighten the bolts to immobilize the mounting bracket.

Although the antenna may be considered "sufficiently" pointed, the gain of the beam in the direction of the target antenna may be less than the boresight direction of maximum gain of the beam. This may for example be due to manual pointing accuracy limitations, and/or a relatively low requirement for considering when the pointing is sufficient in order to account for location-dependent signal metric variation. In addition, once sufficiently pointed, the direction of the beam of the antenna may shift slightly as the installer locks down the mounting bracket. Furthermore, the antenna may remain in service for a long time after installation. Over this time, several influences can cause the antenna to move and thus change the direction of the beam. For example, the mounting bracket may slip, the object on which the antenna is mounted can shift slightly, there may be an impact to the antenna (e.g., a ball striking the antenna), etc.

The misalignment between the boresight direction of the beam of the antenna and the direction of the target antenna cause pointing errors that can have a significant detrimental effect on the quality of the link between the antenna and the target. Small misalignment may be compensated for by reducing a modulation and coding rate of signals communicated between the antenna and the target. However, to maintain a given data rate (e.g., bits-per-second (bps), this approach may increase system resource usage and thus result in inefficient use of the resources. In addition, after installation it may be difficult to determine whether performance degradation is due to misalignment of the antenna or some other cause. Diagnosing degraded performance may require rolling a truck to the location of the antenna so a technician can determine the cause and attempt to correct it, which increases costs for managing the system.

SUMMARY

In one embodiment, an antenna assembly is described. The antenna assembly includes and antenna and an antenna positioner coupled to the antenna. The antenna positioner includes a single drive interface and a plurality of gears. The plurality of gears rotate in a first manner in response to a first drive direction applied through the single drive interface, and rotate in a second manner in response to a second drive applied through the single drive interface. The antenna positioner also includes a threaded rod that moves in a first rod direction and a second rod direction in response to rotation of the plurality of gears in the first manner and the second manner respectively. The antenna positioner also includes a tilt plate contacting the threaded rod. The tilt plate tilts about a pivot line in response to movement of the threaded rod to move a beam of the antenna in a spiral pattern.

In another embodiment, a method of antenna pointing is described. The method includes providing an antenna positioner coupled to an antenna. The antenna positioner includes a single drive interface, a plurality of gears, and a threaded rod contacting a tilt plate. The method further includes driving the single drive interface to rotate the plurality of gears. The method further includes moving the threaded rod in a first rod direction in response to rotation of the plurality of gears. The method further includes tilting the tilt plate of the tilt assembly about a pivot line in response to movement of the threaded rod to move a beam of the antenna in a spiral pattern.

Other aspects and advantages of the present disclosure can be seen on review of the drawings, the detailed description, and the claims which follow.

DETAILED DESCRIPTION

An antenna assembly as described herein may provide very accurate alignment of an antenna with a target (e.g., a target antenna on a geostationary satellite, etc.) at installation, as well as correct misalignment that may occur over time. The antenna assembly may provide self-peaking capability during installation, as well as permit remote re-alignment over time. As described in more detail below, the antenna assembly may include a tilt assembly having a single drive interface that may be driven (e.g., by a single bi-directional motor) to move a beam of the antenna in a spiral pattern. In doing so, the beam may be scanned in two-dimensions (e.g., azimuth and elevation) via the single drive interface. As a result, the tilt assembly may provide two-dimensional beam scanning in a more cost-effective and compact manner, as compared to a two-axis or three-axis positioner that includes multiple motors driving separate interfaces that independently provide adjustment in each axis.

The methods, systems and devices described herein may reduce the operational cost of installation and maintenance for antennas (e.g., satellite antennas, etc.) and improve resource efficiency of communication systems using such antennas. For example, achieving and maintaining accurate alignment between the antenna and a target may reduce the necessary system resources for maintaining a given data rate by increasing the allowable coding rate (e.g., decreasing data redundancy), which may increase overall system performance. In addition, by remotely re-aligning the antenna over time, truck rolls may be avoided and performance degradation issues resolved more quickly, which may improve the customer experience and reduce the impact of degraded performance on the overall system.

Figure 1:
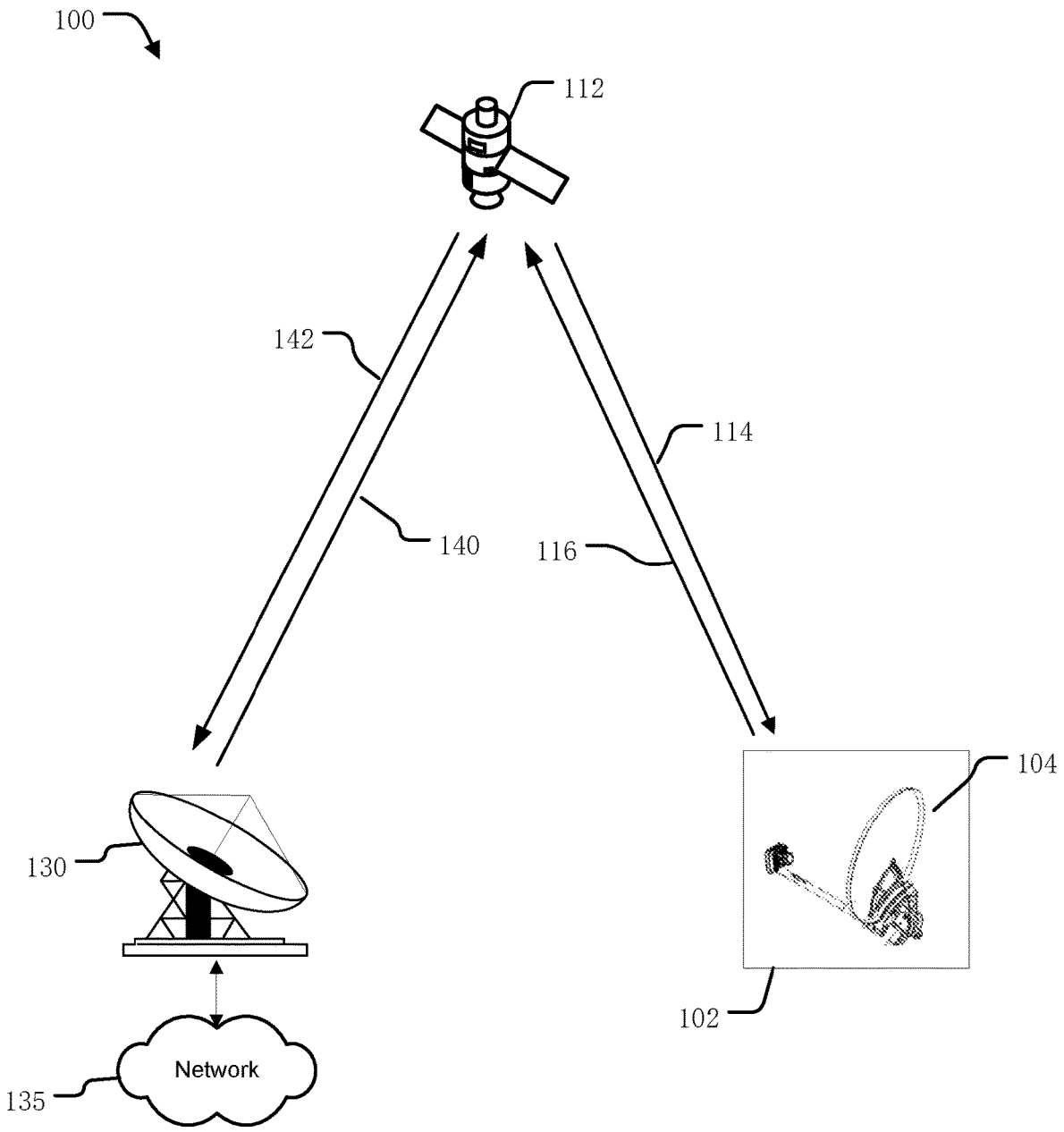
FIG. 1 illustrates an example two-way satellite communications system in which an antenna assembly 104 as described herein can be used.

FIG. 1 illustrates an example two-way satellite communications system 100 in which an antenna assembly 104 (not to scale) as described herein can be used. Many other configurations are possible having more or fewer components than the two-way satellite communications system 100. Although examples described herein use a satellite communications system for illustrative purposes, the antenna assembly 104 and techniques described herein are not limited to such satellite communication embodiments. For example, the antenna assembly 104 and techniques described herein could be used for point-to-point terrestrial links and also may not be limited to two-way communication. In one embodiment, the antenna assembly 104 may be used for a receive-only implementation, such as for receiving satellite broadcast television.

The antenna assembly 104 may for example be attached to a structure such as the roof or side wall of a house. As described in more detail below, the antenna assembly 104 includes an antenna positioner that may provide very accurate alignment of an antenna of the antenna assembly 104 with a target (e.g., a target antenna on a geostationary satellite 112, etc.) at installation, as well as correct misalignment that may occur over time.

In the illustrated embodiment, the antenna assembly 104 is part of a fixed user terminal 102. The fixed user terminal 102 may also include memory for storage of data and software applications, a processor for accessing data and executing applications, and components that facilitate communication over the two-way satellite communication system 100. Although only one fixed user terminal 102 is illustrated in FIG. 1 to avoid over complication of the drawing, the two-way satellite communication system 100 may include many fixed user terminals 102.

In the illustrated embodiment, satellite 112 provides bidirectional communication between the fixed user terminal 102 and a gateway terminal 130. The gateway terminal 130 is sometimes referred to as a hub or ground station. The gateway terminal 130 includes an antenna to transmit a forward uplink signal 140 to the satellite 112 and to receive a return downlink signal 142 from the satellite 112. The gateway terminal 130 may also schedule traffic to the fixed user terminal 102. Alternatively, the scheduling may be performed in other elements of the two-way satellite communication system 100 (e.g., a core node, network operations center (NOC), or other components, not shown). Signals 140, 142 communicated between gateway terminal 130 and satellite 112 may use the same, overlapping or different frequencies as signals 114, 116 communicated between satellite 112 and fixed user terminal 102. Gateway terminal 130 may be located remotely from fixed user terminal 102 to enable frequency reuse. By separating the gateway terminal 130 and the fixed user terminal 102, spot beams with common frequency bands can be geographically separated to avoid interference.

Network 135 is interfaced with the gateway terminal 130. The network 135 may be any type of network and can include for example, the Internet, an IP network, an intranet, a wide area network (WAN), a local area network (LAN), a virtual private network (VPN), a virtual LAN (VLAN), a fiber optic network, a cable network, a public switched telephone network (PSTN), a public switched data network (PSDN), a public land mobile network, and/or any other type of network supporting communication between devices as described herein. The network 135 may include both wired and wireless connections as well as optical links. The network 135 may connect multiple gateway terminals 130 that may be in communication with satellite 112 and/or with other satellites.

The gateway terminal 130 may be provided as an interface between the network 135 and the satellite 112. The gateway terminal 130 may be configured to receive data and information directed to the fixed user terminal 102. The gateway terminal 130 may format the data and information and transmit forward uplink signal 140 to the satellite 112 for delivery to the fixed user terminal 102. Similarly, the gateway terminal 130 may be configured to receive return downlink signal 142 from the satellite 112 (e.g. containing data and information originating from the fixed user terminal 102) that is directed to a destination accessible via the network 135. The gateway terminal 130 may also format the received return downlink signal 142 for transmission on the network 135.

The satellite 112 receives the forward uplink signal 140 from the gateway terminal 130 and transmits corresponding forward downlink signal 114 to the fixed user terminal 102. Similarly, the satellite 112 receives return uplink signal 116 from the fixed user terminal 102 and transmits corresponding return downlink signal 142 to the gateway terminal 130. The satellite 112 may operate in a multiple spot beam mode, transmitting and receiving a number of narrow beams directed to different regions on Earth. This allows for segregation of fixed user terminals 102 into various narrow beams. Alternatively, the satellite 112 may operate in wide area coverage beam mode, transmitting one or more wide area coverage beams.

The satellite 112 may be configured as a "bent pipe" satellite that performs frequency and polarization conversion of the received signals before retransmission of the signals to their destination. As another example, the satellite 112 may be configured as a regenerative satellite that demodulates and remodulates the received signals before retransmission.

The antenna assembly 104 includes an antenna that produces a beam pointed at the satellite 112 to facilitate communication between the fixed user terminal 102 and satellite 112. In the illustrated embodiment, the fixed user terminal 102 includes a transceiver (not shown) to transmit to and receive signals with satellite 112. In the illustrated embodiments described below, the antenna of the antenna assembly 104 is a reflector antenna that includes a feed to illuminate a reflector to produce the beam pointed at the satellite 112 to provide for transmission of the return uplink signal 116 and reception of the forward downlink signal 114. Alternatively, the antenna of the antenna assembly 104 may be a different antenna type than a reflector antenna. For example, in some embodiments the antenna of the antenna assembly 104 is a panel antenna such as a phased array antenna, a slot array, an open ended waveguide array, etc.

Figure 2:
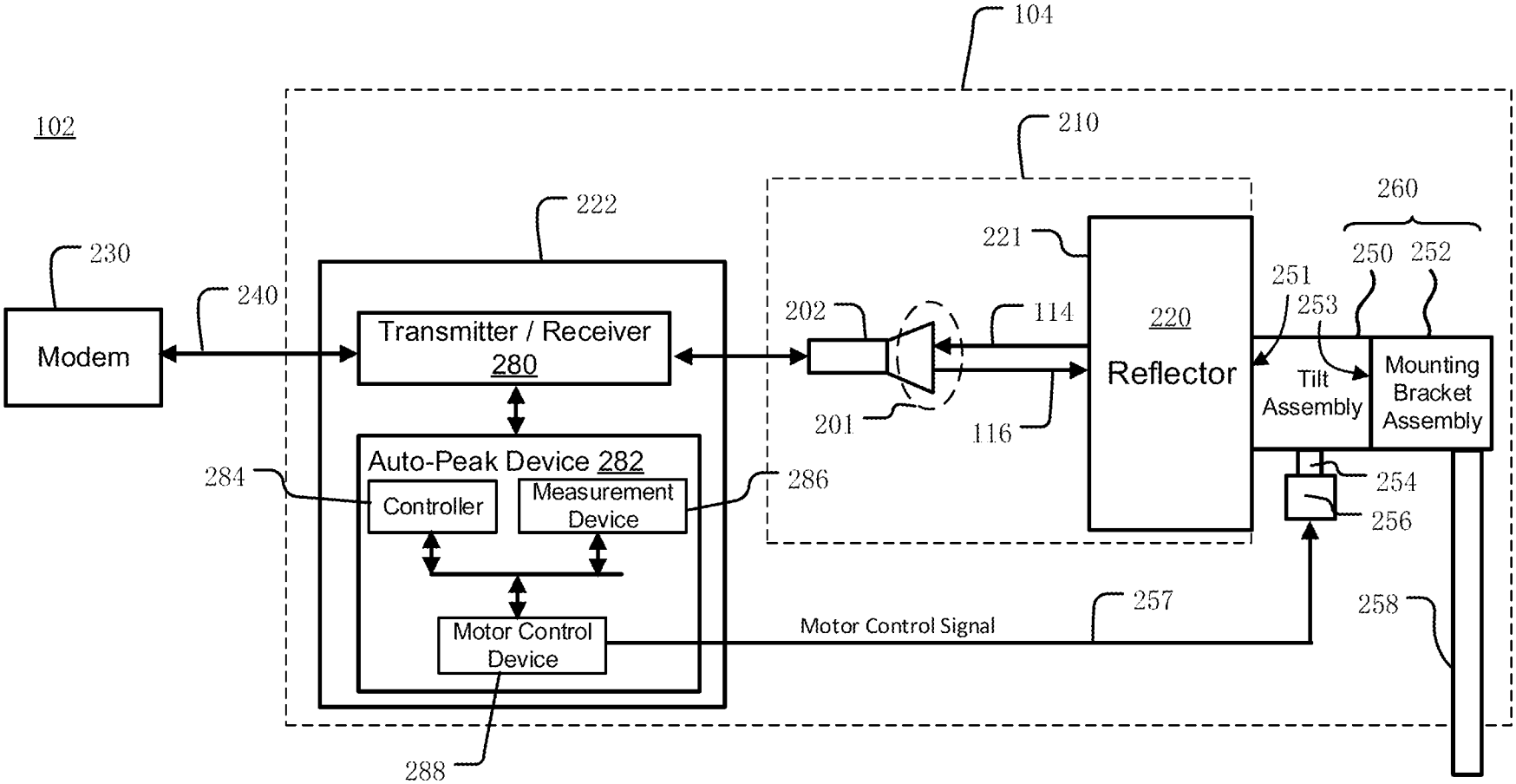
FIG. 2 is a block diagram illustrating an example of the fixed user terminal of FIG. 1.

FIG. 2 is a block diagram illustrating an example of the fixed user terminal 102 of FIG. 1. Many other configurations are possible having more or fewer components than the fixed user terminal 102 shown in FIG. 2. Moreover, the functionalities described herein can be distributed among the components in a different manner than described herein.

The antenna assembly 104 includes antenna 210. In the illustrated embodiment, the antenna 210 is a reflector antenna and includes feed 202 that illuminates a reflector surface 221 of reflector 220. The reflector surface 221 comprises one or more electrically conductive materials that reflect electromagnetic energy. In the illustrated embodiment, the feed 202 directly illuminates the reflector surface 221.

The shape of the reflector surface 221 is designed to define a focal region 201. The feed 202 is within the focal region 201 to illuminate the reflector surface 221 to produce a beam pointed towards the satellite 112. The focal region 201 is a three-dimensional volume within which the reflector surface 221 causes electromagnetic energy to converge sufficient to permit signal communication having desired performance characteristics if an incident plane wave arrives from the direction of satellite 112. Reciprocally, the reflector surface 221 reflects electromagnetic energy originating from the feed 202 at a location within the focal region 201 such that the reflected electromagnetic energy adds constructively in the direction of the satellite 112 sufficient to permit signal communication having desired performance characteristics, while partially or completely cancelling out in all other directions.

As shown in FIG. 2, the feed 202 illuminates the reflector surface 221 to produce a beam pointing using the techniques described herein to provide for transmission of the return uplink signal 116 and reception of the forward downlink signal 114 with the satellite 112. That is, the forward downlink signal 114 from the satellite 112 is focused by the reflector surface 221 and received by the feed 202 positioned within the focal region 201. Similarly, the return uplink signal 116 from the feed is reflected by the reflector surface to focus the return uplink signal 116 in the direction of the satellite 112.

The feed 202 may for example be a waveguide-type feed structure including a horn antenna and may include dielectric inserts. Alternatively, other types of structures and feed elements may be used.

The feed 202 communicates the return uplink signal 116 and the forward downlink signal 114 with transceiver 222 to provide for bidirectional communication with the satellite 112. In the illustrated embodiment, transceiver 222 is located on the antenna assembly 104. Alternatively, the transceiver 222 may be located in a different location that is not on the antenna assembly 104.

The transceiver 222 includes a receiver within transmitter/receiver 280 that can amplify and then downconvert the forward downlink signal 114 from the feed to generate an intermediate frequency (IF) receive signal for delivery to modem 230. Similarly, the transceiver 222 includes a transmitter within transmitter/receiver 280 that can upconvert and then amplify an IF transmit signal received from modem 230 to generate the return uplink signal 116 for delivery to the feed 202. In some embodiments in which the satellite 112 operates in a multiple spot beam mode, the frequency ranges and/or the polarizations of the return uplink signal 116 and the forward downlink signal 114 may be different for the various spot beams. Thus, the transceiver 222 may be within the coverage area of one or more spot beams, and may be configurable to match the polarization and the frequency range of a particular spot beam. The modem 230 may for example be located inside the structure to which the antenna assembly 104 is attached. As another example, the modem 230 may be located on the antenna assembly 104, such as being incorporated within the transceiver 222.

In the illustrated embodiment, the transceiver 222 communicates the IF receive signal and IF transmit signal with modem 230 via IF/DC cabling 240 that is also used to provide DC power to the transceiver 222. Alternatively, the transceiver 222 and the modem 230 may for example communicate the IF transmit signal and IF receive signal wirelessly.

The modem 230 respectively modulates and demodulates the IF receive and transmit signals to communicate data with a router (not shown). The router may for example route the data among one or more end user devices (not shown), such as laptop computers, tablets, mobile phones, etc., to provide bidirectional data communications, such as two-way Internet and/or telephone service.

The antenna assembly 104 also includes an antenna positioner 260 to change the direction of the beam of the antenna 210 to point accurately point the beam at the satellite 112 using the techniques described herein. In the illustrated embodiment, the antenna positioner 260 is attached to the back of the reflector 220 and includes tilt assembly 250 and mounting bracket assembly 252. As described in more detail below, the mounting bracket assembly 252 may be used to coarsely point the beam of the antenna 210 at the satellite 112, while the tilt assembly 250 can then be used to fine tune the pointing of the beam. In embodiments described herein, the angular displacement of the beam provided by the tilt assembly 250 is less than the angular displacement of the beam provided by the mounting bracket assembly 252. For example, in some embodiments the mounting bracket assembly 252 may provide adjustment of beam over a range of elevation angles and a range of azimuth angles (e.g., full 90 degrees in elevation, and full 360 degrees in azimuth), while the tilt assembly 250 may provide adjustment over less than those ranges (e.g., 4 degrees in elevation, and 4 degrees in azimuth).

In the illustrated embodiment, mounting bracket assembly 252 is attached to mast 258, which in turn is attached to a stationary structure (e.g., ground, a building or other structure, etc.) not shown in FIG. 2. The mounting bracket assembly 252 may be of a conventional design and can include azimuth, elevation and skew adjustments of the antenna assembly 104 relative to mast 258. Elevation refers to the angle between the centerline of the reflector 220 and the horizon. Azimuth refers to the angle between the centerline of the reflector 220 and the direction of true north in a horizontal plane. Skew refers to the angle of rotation about the centerline.

The mounting bracket assembly 252 may for example include bolts that can be loosened to permit the antenna assembly 104 to be moved in azimuth, elevation and skew. After positioning the antenna assembly 104 to the desired position in one of azimuth, elevation and skew, the bolts for that portion of the mounting bracket assembly 252 can be tightened and other bolts loosened to permit a second adjustment to be made.

As described in more detail below, an installer may use the mounting bracket assembly 252 to coarsely point the beam of the antenna 210 in a direction generally towards at the satellite 112 (or other target). The coarse pointing may have a pointing error (e.g., due to manual pointing accuracy limitations), which results in the gain of the beam in the direction of the satellite 112 being less than the boresight direction of maximum gain of the beam. For example, the direction of the target of the satellite 112 may be within the 1 dB beamwidth of the beam.

The installer may use a variety of techniques to coarsely point the beam of the antenna 210 at the satellite 112. For example, initial azimuth, elevation and skew angles for pointing the beam of the antenna 210 may be determined by the installer based on the known location of the satellite 112 and the known geographic location where the antenna assembly 104 is being installed. In embodiments in which the reflector surface 221 is not symmetric about the boresight axis and correspondingly has major and minor beamwidth values in two planes, the installer can adjust the skew angle of the mounting bracket assembly 252 until the major axis of the reflector surface 221 (the longest line through the center of the reflector 220) is aligned with the geostationary arc.

Once the beam of the antenna 210 has been initially pointed in the general direction of the satellite 112, the elevation and/or azimuth angles can be further adjusted by the installer until the beam of the antenna 210 is sufficiently coarsely pointed at the satellite 112. The techniques for determining when the beam of the antenna 210 is sufficiently coarsely pointed at the satellite 112 can vary from embodiment to embodiment.

In some embodiments, the beam of the antenna 210 may be coarsely pointed using signal strength of a signal received from the satellite 112 via the feed 202, such as the forward downlink signal 114. In other embodiments, the beam of the antenna 210 may also or alternatively be coarsely pointed using information in the received signal indicating the signal strength of a signal received by the satellite 112 from the antenna 210, such as the return uplink signal 116. Other metrics and techniques may also or alternatively be used to coarsely point the beam of the antenna 210.

In embodiments in which the received signal strength is used, a measurement device such as a power meter may be used to directly measure the signal strength of the received signal. Alternatively, a measurement device may be used to measure some other metric indicating signal quality of the received signal. The measurement device may for example be an external device that the installer temporarily attaches the feed 202. As another example, the measurement device may be incorporated into the transceiver 222, such as measurement device 286 of auto-peak device 282 (discussed in more detail below). In such a case, the measurement device may for example produce audible tones indicating signal strength to assist the installer in pointing the beam of the antenna 210.

The installer can then iteratively adjust the elevation and/or azimuth angle of the mounting bracket assembly 252 until the received signal strength (or other metric), as measured by the measurement device, reaches a predetermined value. In some embodiments, the installer adjusts the mounting bracket assembly 252 in an attempt to maximize the received signal strength. Alternatively, other techniques may be used to determine when the beam of the antenna 210 is sufficiently coarsely pointed.

Once the beam is sufficiently coarsely pointed in the direction of the satellite 112, the installer can immobilize the mounting bracket assembly 252 to preclude further movement of the beam by the mounting bracket assembly 252. As described in more detail below, the installer can then use the tilt assembly 250 to fine tune the pointing of the beam of the antenna 210 in order to more accurately point the boresight direction beam in the direction of the satellite 112 (i.e., reduce the pointing error).

The tilt assembly 250 includes a single drive interface 254 that may be driven to move the direction of the beam of the antenna 210 in a spiral pattern to fine tune the pointing of the beam about the coarsely pointed direction of the beam. The spiral pattern is a projection onto a plane that is perpendicular to the coarsely pointed direction. In doing so, the beam may be scanned in two-dimensions (e.g., azimuth and elevation) by the tilt assembly 250 via the single drive interface 254, so that the pointing in both dimensions can be adjusted if needed. The tilt assembly 250 may be designed such that a maximum scan angle of the beam between successive turns along the spiral pattern is relatively small compared to the beamwidth of the beam of the antenna 210 (e.g., less than a 1-dB beamwidth of the beam), which can ensure there is a location along the spiral pattern at which the beam will be sufficiently finely pointed at the satellite 112.

As described in more detail below, the tilt assembly 250 includes a tilt plate 251 connected to the back of the reflector 220. The tilt assembly 250 also includes a base plate 253 connected to the mounting bracket assembly 252. The tilt assembly 250 further includes gears (not shown) and one or more threaded rods (not shown), that in response to a drive applied to the single drive interface 254, cause the tilt plate 251 to tilt relative to the base plate 253 but not rotate the tilt plate 251 itself, such that a surface normal of the tilt plate 251 moves along a first spiral pattern. In doing so, the tilt assembly 250 tilts the reflector 220 relative to the mounting bracket assembly 252 and thus to the mast 258 and corresponding stationary structure, thereby moving the direction of the beam of the antenna 210 along a second spiral pattern.

The manner in which the surface normal of the tilt plate 251 moves along the first spiral pattern, relative to the movement of the direction of the beam of the antenna 210 along the second spiral pattern, can vary from embodiment to embodiment. In some embodiments, the feed 202 is attached to the reflector 220 using a support boom or other intermediate structure, such that the location of the feed 202 relative to reflector 220 is fixed. As used herein, two elements are "fixedly attached" when they are coupled to each other in fixed physical relationship (i.e., distance and orientation) relative to each other in a manner that is not readily adjusted (e.g., by an end user). In such a case, the tilt assembly 250 tilts the reflector 220 and the feed 202 together to move the direction of the beam of the antenna 210 along the spiral pattern. As a result, the surface normal of the tilt plate 251 and the direction of the beam generally undergo the same amount of angular displacement and may move along the same spiral pattern.

In other embodiments, the feed 202 is attached to a different element (e.g., mounting bracket assembly 252) of the antenna assembly 104, such that the tilt assembly 250 tilts the reflector 220 without tilting the feed 202 when moving the direction of the beam of the antenna 210 along the spiral pattern. In such a case, the angular displacement of the surface normal of the tilt plate 251 can generally result in twice the angular displacement of the direction of the beam, due to the signal reflection off the reflector surface 221. However, the angular displacement of the reflector 220 may be limited due to desired level of performance, as the focal region 201 will also move relative to the location of the feed 202.

In the illustrated embodiment, a bi-directional motor 256 is coupled to the single drive interface 254 that is capable of applying clockwise and counter-clockwise drive rotation applied to the single drive interface 254. In some embodiments, the motor 256 is fixedly attached to the single drive interface 254. In other embodiments, the motor 256 is temporarily attached during installation of the antenna assembly 104. In yet other embodiments, the motor 256 is omitted and the installer may manually drive the single drive interface 254 using for example a hand crank or other tool.

In the illustrated embodiment, an auto-peak device 282 incorporated in the transceiver 222 performs an automated process to perform the fine pointing of the beam using the tilt assembly 250. In other embodiments, the auto-peak device 282 may be a separate component. In FIG. 2 the auto-peak device 282 includes controller 284, measurement device 286, and motor control device 288. Many other configurations are possible having more or fewer components than the auto-peak device 282 shown in FIG. 2. Moreover, the functionalities described herein can be distributed among the components in a different manner than described herein.

The controller 284 may control operation of the measurement device 286 and the motor control device 288 to perform the fine pointing operation of the beam via the tilt assembly 250 using the techniques described herein. The functions of the controller 284 can be implemented in hardware, instructions embodied in memory and formatted to be executed by one or more general or application specific processors, firmware, or any combination thereof.

The controller 284 can be responsive to a received command to begin the fine pointing operation of the beam of the antenna 210. The command may for example be transmitted to the fixed user terminal 102 by the gateway terminal 130 (or other elements of the two-way satellite communication system 100 such as a core node, NOC, etc.) via the forward downlink signal 114 upon completion of the coarse pointing operation. For example, the command may be transmitted via the forward downlink signal 114 upon initial entry of the fixed user terminal 102 into the network. In other embodiments, the command may be received from equipment (e.g., a cell phone, laptop) carried by the installer. In such a case, the installer may indicate successful completion of the coarse pointing operation via input on an interface on the equipment, which results in the equipment then transmitting the command to the controller 284 to initiate the fine pointing operation. In yet other embodiments, the installer equipment may communicate successful completion of the coarse pointing operation to gateway terminal 130 (or element of the two-way satellite communication system 100 such as a core node, NOC, etc.), which in turn then transmits the command to the controller 284 to being the fine pointing operation.

During the fine pointing operation, the motor control device 288 can provide a motor control signal on line 257 to motor 256 to drive the single drive interface 254 and move the tilt plate 251 of the tilt assembly 250 to various tilt positions, which in turn moves the beam of the antenna 210 to various angular positions along the spiral pattern. At the same time, the measurement device 286 may be used to measure the received signal strength at the various tilt positions. In some embodiments, the measurement device 286 is a power meter. Upon moving the direction of the beam along the spiral pattern, the controller 284 can then select the final tilt position of the tilt plate 251, and thus the final direction to point the beam of the antenna 210, based on the measured signal strength (e.g., the tilt position corresponding to the maximum measured signal strength). The controller 284 can then command the motor control device 288 to provide the motor control signal to the motor 256 to drive the single drive interface 254 to tilt the tilt plate 251 to the selected tilt position. Alternatively, other techniques may be used to determine the final tilt position of the tilt plate 251. For example, in some embodiments, the beam of the antenna 210 may also or alternatively be finely pointed using information in the received signal indicating the signal strength of a signal received by the satellite 112 from the antenna 210, such as the return uplink signal 116.

In some embodiments, prior to commanding the motor control device 288 to tilt the tilt plate 251 to the selected tilt position, the controller 284 may compare the selected tilt position to the overall range of adjustment provided by the tilt assembly 250. For example, the controller 284 may determine whether the selected tilt position is less than a threshold amount from the end of the overall range of adjustment provided by the tilt assembly 250. In other words, the controller 284 may determine whether the selected tilt position is too near the outer edge of the spiral pattern. If the selected tilt position is greater than the threshold amount from the edge of the overall range of adjustment (i.e., sufficiently close to the center of the spiral pattern), the tilt assembly 250 may be considered to have sufficient angular displacement after installation to permit remote re-alignment over time. In such a case, the controller 284 can then command the motor control device 288 to drive the single drive interface 254 to tilt the tilt plate 251 to the selected tilt position. However, if the selected tilt position is less than the threshold amount from the end of the overall range of adjustment, the controller 284 may cause the installer to be notified that another coarse pointing operation of the beam of the antenna 210 is required. The manner in which the controller 284 notifies the installer can vary from embodiment to embodiment. For example, the controller 284 may notify the installer by commanding the measurement device 286 to produce an audible tone indicating that another coarse pointing operation is required. As another example, in embodiments in which the installer carries equipment (e.g., a cell phone, laptop, etc.), the controller 284 may transmit a command to the installer equipment indicating that another coarse pointing operation is required.

In the illustrated embodiment, the bi-directional motor 256 drives the single drive interface 254 in response to the motor control signal received on line 257 from motor control device 288 of auto-peak device 282 incorporated in the transceiver 222. Alternatively, the motor control signal may be provided to the bi-directional motor 256 using a separate motor control device. For example, the separate motor control device may be on the antenna assembly 104. As another example, the motor control device may be incorporated in the measurement device (discussed above) used by the installer during the coarse pointing.

In embodiments described above, the auto-peak device 282 is used to fine tune the pointing of the beam of the antenna 210 during installation of the antenna assembly 104. In some embodiments in which the auto-peak device 282 is part of the antenna assembly 104, the auto-peak device 282 may also or alternatively be used to fine tune pointing of the beam of the antenna 210 from time to time after the installation. In particular, once the fixed user terminal 102 has been installed and is in use, the auto-peak device 282 can permit the beam of the antenna 210 to be fine tune pointing of the beam from time to time without requiring a technician or other person to be present at the installation location of the fixed user terminal 102. The auto-peak device 282 may for example automatically perform fine tune pointing process using the tilt assembly 250 periodically.

In some embodiments, the auto-peak device 282 may perform the fine tune pointing process in response to detection of performance degradation that could be caused by a change in the direction of the beam. The manner in which the performance degradation is detected and the auto-peak device 282 initiates the fine pointing operation can vary from embodiment to embodiment. In some embodiments, the auto-peak device 282 may include memory for storing the measured signal strength made by the measurement device 286 during installation, and compare that stored measured signal strength to a current measurement made by the measurement device 286. The auto-peak device 282 may then initiate the fine tune pointing operation if the difference between the current measured signal strength and the stored measured signal strength exceeds a threshold.

In some embodiments, the gateway terminal 130 (or other elements of the two-way satellite communication system 100 such as a core node, NOC, etc.) may monitor operation of the fixed user terminal 102 remotely, and transmit a command to the auto-peak device via the forward downlink signal 114 upon detection of possible performance degradation that could be caused by a change in the direction of the beam. If the performance degradation is not corrected following the fine pointing operation, the performance degradation may not be due to mispointing and a truck roll may be scheduled so that a technician can determine the cause. In some embodiments, the gateway terminal 130 or other elements of the two-way satellite communication system 100 may transmit the command from time to time to ensure the beam of the antenna 210 remains pointed accurately at the satellite 112, regardless of whether performance degradation has been detected.

Figure 3:
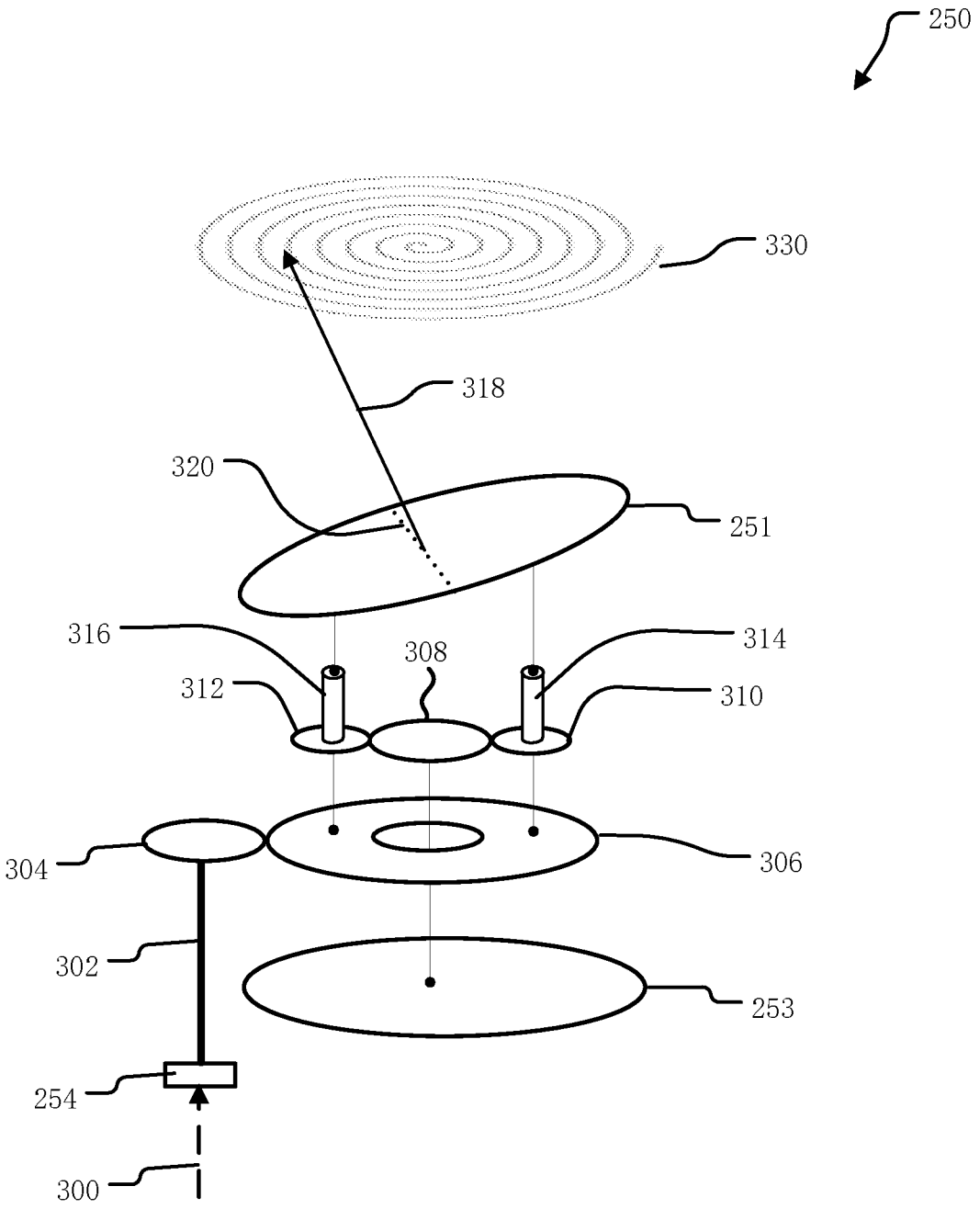
FIG. 3 is a schematic diagram of an example tilt assembly.

FIG. 3 is a schematic diagram of an example tilt assembly 250. Many other configurations are possible having more or fewer components than the tilt assembly 250 of FIG. 3.

In the illustrated embodiment, the single drive interface 254 is the bottom of a drive shaft 302. The drive shaft 302 is connected to a drive gear 304 that is meshed with a ring gear 306. A center gear 308 overlies the ring gear 306 and is connected to base plate 253 through a center opening in the ring gear 306. A first planetary gear 310 and a second planetary gear 312 are each coupled to the ring gear 306 and meshed with the center gear 308. In the illustrated embodiment, the first and second planetary gears 310, 312 are on opposing sides of the center gear 308.

A first threaded rod 314 is threaded within the first planetary gear 310 and a second threaded rod 316 is threaded within the second planetary gear 312. As described in more detail below, the first threaded rod 314 has threads that are opposite the threads of the second threaded rod 316, so that in response to a drive 300 applied to the single drive interface 254, one of the first and second threaded rods 314, 316 will extend away from the ring gear 306 (also referred to herein as moving in a first rod direction) while the other of the first and second threaded rods 314, 316 will retract towards the ring gear 306 (also referred to herein as moving in a second rod direction). In other words, as the length of the first threaded rod 314 above the first planetary gear 310 increases, the length of the second threaded rod 316 above the second planetary gear 312 decreases, and vice versa depending on the rotation direction.

The first and second threaded rods 314, 316 are each in slidable contact with the tilt plate 251 at respective contact points. As a result, the relative lengths of the first and second threaded rods 314, 316 define the tilt angle of the tilt plate 251. In FIG. 3, the tilt angle is the angle between a horizontal line and the tilt plate 251. As the lengths of the first and second threaded rods 314, 316 change, the tilt plate 251 tilts about pivot line 320 to change the tilt angle.

As described in more detail below, the first and second planetary gears 310, 312 rotate about the central axis of the ring gear 306 in response to the drive 300 applied to the single drive interface 254. As a result, the first and second threaded rods 314, 316 also rotate about the central axis of the ring gear 306, and thus contact points between the first and second threaded rods 314, 316 with the tilt plate 251 will also move. This movement of the contact points causes rotation of the pivot line 320 in a plane that bisects the tilt plate 251.

The tilt assembly 250 also includes a flexible coupling (not shown) that precludes rotation of the tilt plate 251 relative to the base plate 253. The type of flexible coupling can vary from embodiment to embodiment. In some embodiments, the flexible coupling is a diaphragm such as a bellows coupled between the tilt plate 251 and the base plate 253 that partially or completely surrounds the perimeters of the tilt plate 251 and the base plate 253. In other embodiments, the flexible coupling may be a universal joint connecting the center of the tilt plate 251 to the center of the base plate 253, so that the tilt plate 251 can tilt but cannot rotate.

The tilt angle of the tilt plate and the orientation of the pivot line 320 define the tilt position of the tilt plate 251. As the tilt position changes due to changes in the tilt angle and the orientation of the pivot line 320, the surface normal 318 of the tilt plate 251 moves along spiral pattern 330.

Figure 4A:
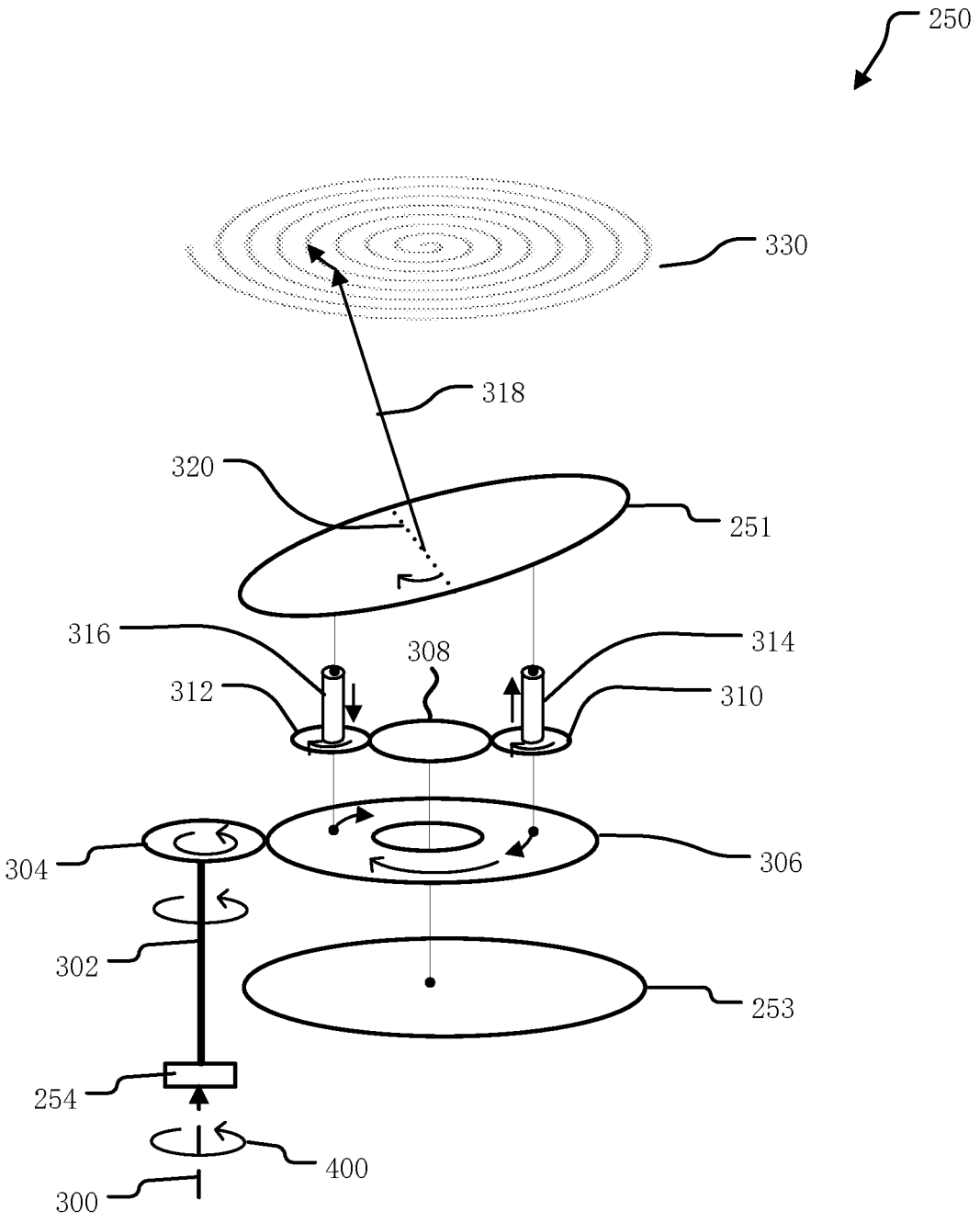
FIG. 4A illustrates an example of movement of the surface normal of the tilt assembly of FIG. 3 along the spiral pattern in response to a first drive direction of drive applied to the single drive interface.

FIG. 4A illustrates an example of movement of the surface normal 318 of the tilt assembly 250 of FIG. 3 along the spiral pattern 330 in response to a first drive direction 400 of drive 300 applied to the single drive interface 254. In the illustrated embodiment, the first drive direction 400 is a counter-clockwise rotation applied to the single drive interface 254 that causes the gears of the tilt assembly 250 to rotate in a first manner. The first drive direction 400 causes shaft 302 to rotate counter-clockwise and thus causes counter-clockwise rotation of the drive gear 304 about a central axis of the drive gear 304. The counter-clockwise rotation of the drive gear 304 is translated into clockwise rotation of the ring gear 306.

The clockwise rotation of the ring gear 306 causes the first and secondary planetary gears 310, 312 to move clockwise about the central axis of the ring gear 306. In addition, due to the meshing of the first planetary gear 310 with center gear 308, as the first planetary gear 310 moves with the ring gear 306, the first planetary gear 310 will also rotate clockwise about its own central axis. Similarly, due to the meshing of the second planetary gear 312 with center gear 308, as the second planetary gear 312 moves with the ring gear 306, the second planetary gear 312 will also rotate clockwise about its own central axis.

As mentioned above, the first threaded rod 314 is threaded with the first planetary gear 310 with threads that are opposite the threads of the second threaded rod 316 with the second planetary gear 312. In the illustrated embodiment, the first threaded rod 314 has left-hand threads, while the second threaded rod 316 has right hand-hand threads. As a result, as the first planetary gear 310 rotates clockwise about its own central axis, the first threaded rod 314 will extend away from first planetary gear 310 and thus increase the length of the first threaded rod 314 that is above the first planetary gear 310. Similarly, as the second planetary gear 312 rotates clockwise about its own central axis, the second threaded rod 316 will retract into the second planetary gear 312 and thus decrease the length of the second threaded rod 316 that is above the second planetary gear 312. The relative changes in the lengths of the first and second threaded rods 314, 316 cause the tilt angle of the tilt plate 251 about the pivot line 320 to increase. In addition, due to the clockwise movement of the first and second planetary gears 310, 312 about the central axis of the ring gear 306, and thus the movement of the first and second threaded rods 314, 316, the contact points between the first and second threaded rods 314, 316 and the tilt plate 251 will also rotate clockwise. As a result, the movement of the first and second threaded rods 314, 316 will cause clockwise rotation of the pivot line 320, but (as discussed above) will not rotate the tilt plate 251 itself.

The combination of the increase in the tilt angle of the tilt plate 251 about the pivot line 320, and the clockwise rotation of the pivot line 320, cause the surface normal 318 of the tilt plate 251 to move outward along the spiral pattern 330. As described above, this in turn causes the beam of the antenna 210 to also move outward along a spiral pattern.

Figure 4B:
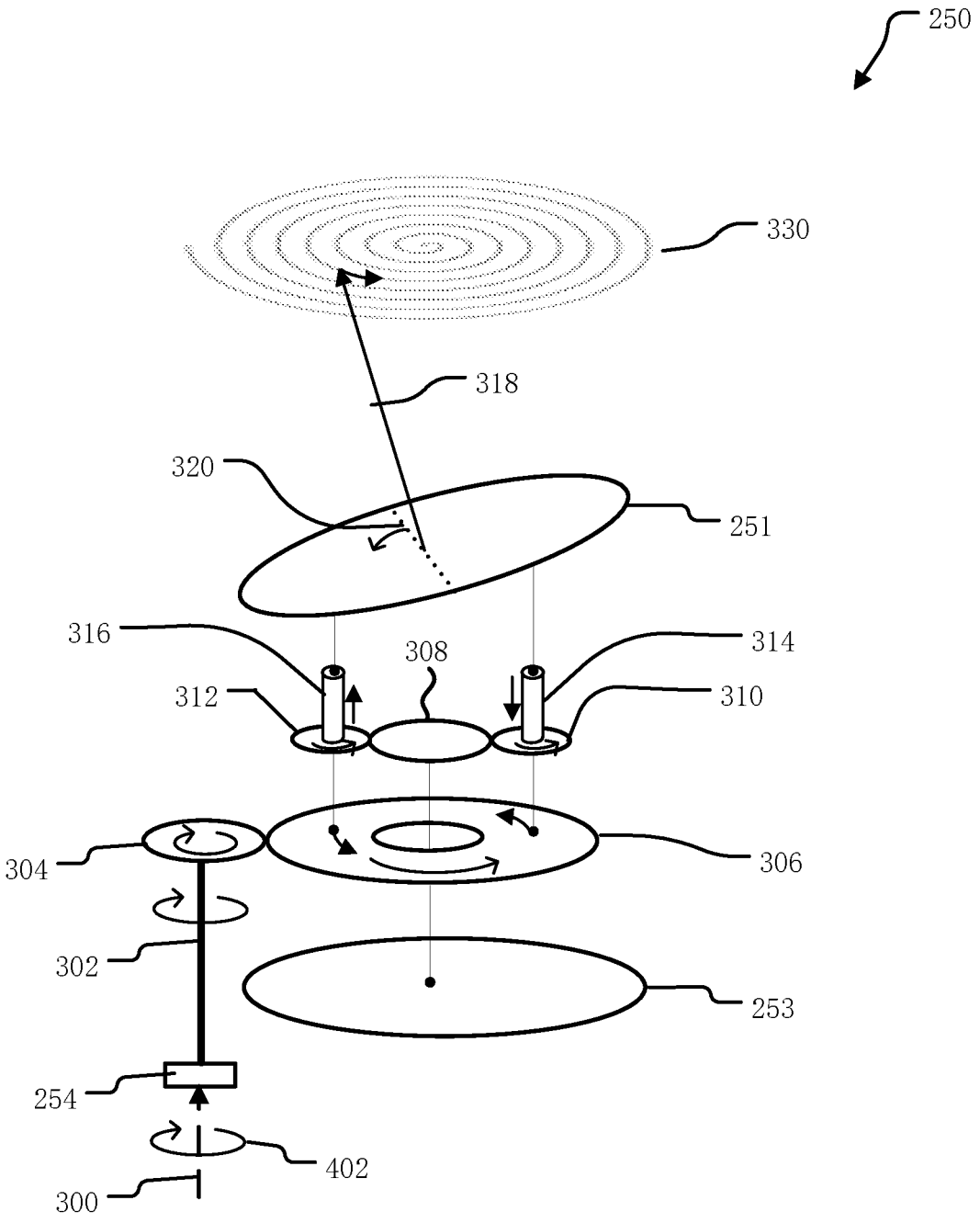
FIG. 4B illustrates an example of movement of the surface normal of the tilt assembly of FIG. 3 along the spiral pattern in response to a second drive direction of drive applied to the single drive interface.

FIG. 4B illustrates an example of movement of the surface normal 318 of the tilt assembly 250 of FIG. 3 along the spiral pattern 330 in response to a second drive direction 402 of drive 300 applied to the single drive interface 254. In the illustrated embodiment, the second drive direction 402 is a clockwise rotation applied to the single drive interface 254 causes the gears of the tilt assembly 250 to rotate in a second manner. The second drive direction 402 causes shaft 302 to rotate clockwise and thus causes clockwise rotation of the drive gear 304 about a central axis of the drive gear 304. The clockwise rotation of the drive gear 304 is translated into counter-clockwise rotation of the ring gear 306.

The counter-clockwise rotation of the ring gear 306 causes the first and second planetary gears 310, 312 to move counter-clockwise about the central axis of the ring gear 306. In addition, due to the meshing of the first planetary gear 310 with center gear 308, as the first planetary gear 310 moves with the ring gear 306, the first planetary gear 310 will also rotate counter-clockwise about its own central axis. Similarly, due to the meshing of the second planetary gear 312 with center gear 308, as the second planetary gear 312 moves with the ring gear 306, the second planetary gear 312 will also rotate counter-clockwise about its own central axis.

As mentioned above, the first threaded rod 314 is threaded with the first planetary gear 310 with threads that are opposite the threads of the second threaded rod 316 with the second planetary gear 312. In the illustrated embodiment, the first threaded rod 314 has left-hand threads, while the second threaded rod 316 has right-hand threads. As a result, as the first planetary gear 310 rotates counter-clockwise about its own central axis, the first threaded rod 314 will retract into first planetary gear 310 and thus decrease the length of the first threaded rod 314 that is above the first planetary gear 310. Similarly, as the second planetary gear 312 rotates counter-clockwise about its own central axis, the second threaded rod 316 will extend away from the second planetary gear 312 and thus increase the length of the second threaded rod 316 that is above the second planetary gear 312. The relative changes in the lengths of the first and second threaded rods 314, 316 cause the tilt angle of the tilt plate 251 about the pivot line 320 to decrease. In addition, due to the counter-clockwise movement of the first and second planetary gears 310, 312 about the central axis of the ring gear 306, and thus the movement of the first and second threaded rods 314, 316, the contact points between the first and second threaded rods 314, 316 and the tilt plate 251 will also rotate counter-clockwise. As a result, the movement of the first and second threaded rods 314, 316 will cause clockwise rotation of the pivot line 320, but (as discussed above) will not rotate the tilt plate 251 itself.

The combination of the decrease in the tilt angle of the tilt plate 251 about the pivot line 320, and the counter-clockwise rotation of the pivot line 320, cause the surface normal 318 of the tilt plate 251 to move inward along the spiral pattern 330. As described above, this in turn causes the beam of the antenna 210 to also move inward along a spiral pattern.

Figure 5:
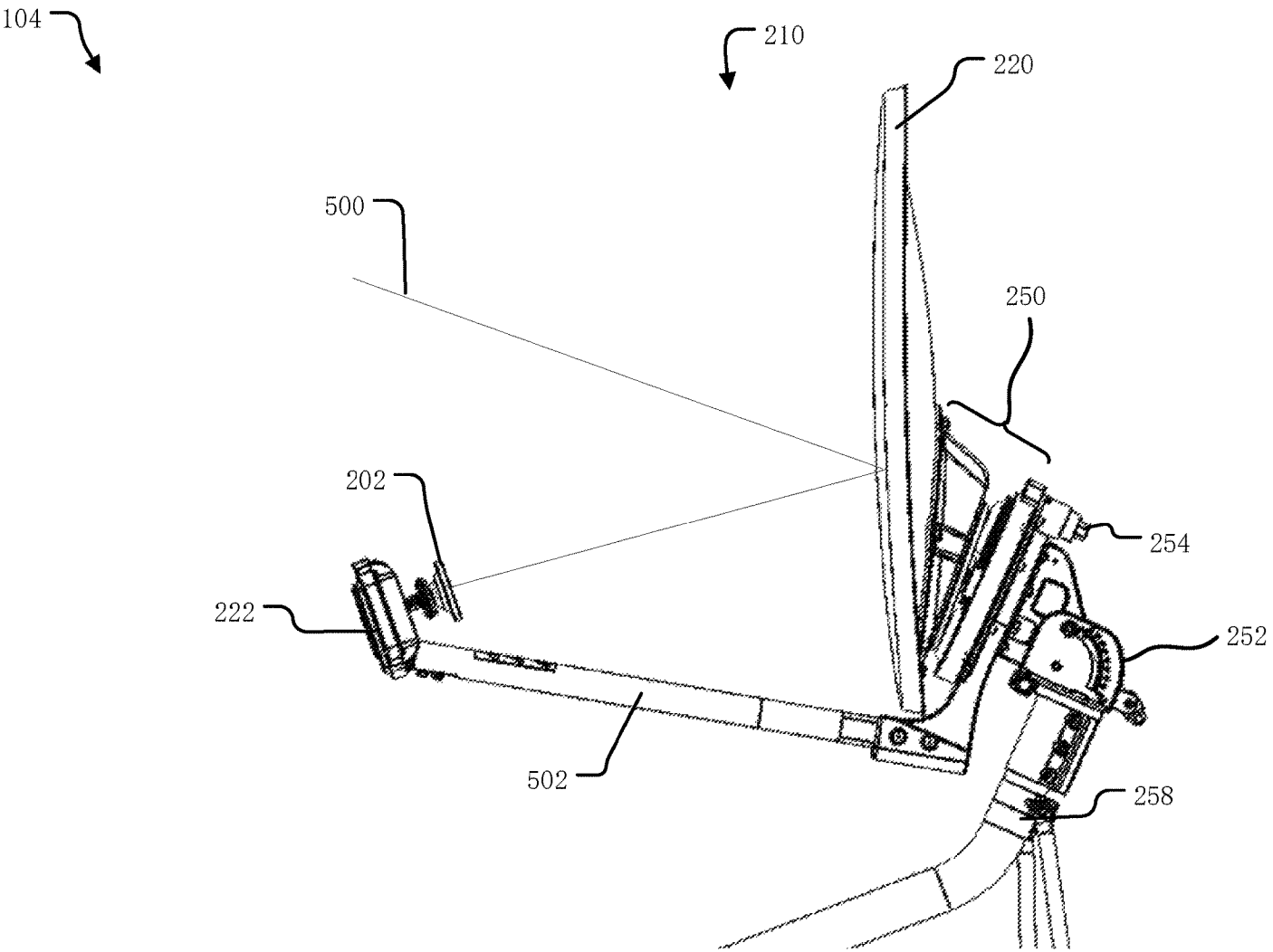
FIG. 5 illustrates a side view of an example antenna assembly.

FIG. 5 illustrates a side view of an example antenna assembly 104. In the illustrated embodiment, feed 202 is attached via support boom 502 at a position between the tilt assembly 250 and the mounting bracket assembly 252. As a result, the tilt assembly 250 will tilt the reflector 220 without tilting the feed 202 when fine pointing the beam of the antenna 210 at the satellite 112. In other embodiments, the support boom 502 may attach the feed 202 to the reflector 220 such that the tilt assembly 250 tilts the reflector 220 and the feed 202 together when fine pointing the beam of the antenna 210 at the satellite 112.

As a result of the position of the feed 202 relative to the reflector 220, the feed 202 illuminates the reflector 220 to produce a beam having a boresight direction along line 500. As discussed above, the mounting bracket assembly 252 can be used to coarsely point the beam in the general direction of the satellite 112. The tilt assembly 250 can then be used to fine tune pointing of the beam at the satellite 112 such that the direction of the satellite is substantially aligned with the boresight direction of the beam along line 500.

Figure 6A:
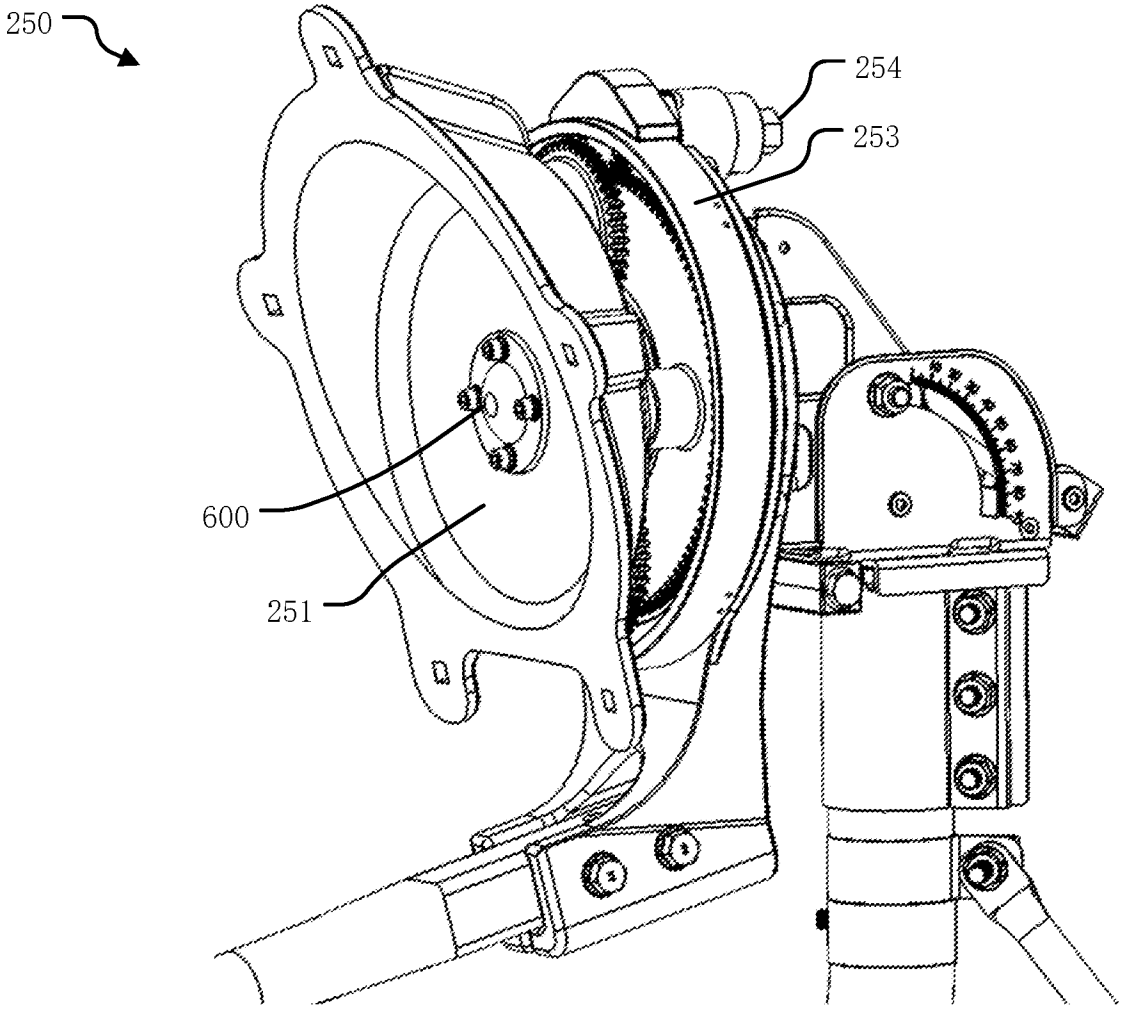
FIGS. 6A-6D illustrate various views of a first example of a tilt assembly.
Figure 6B:
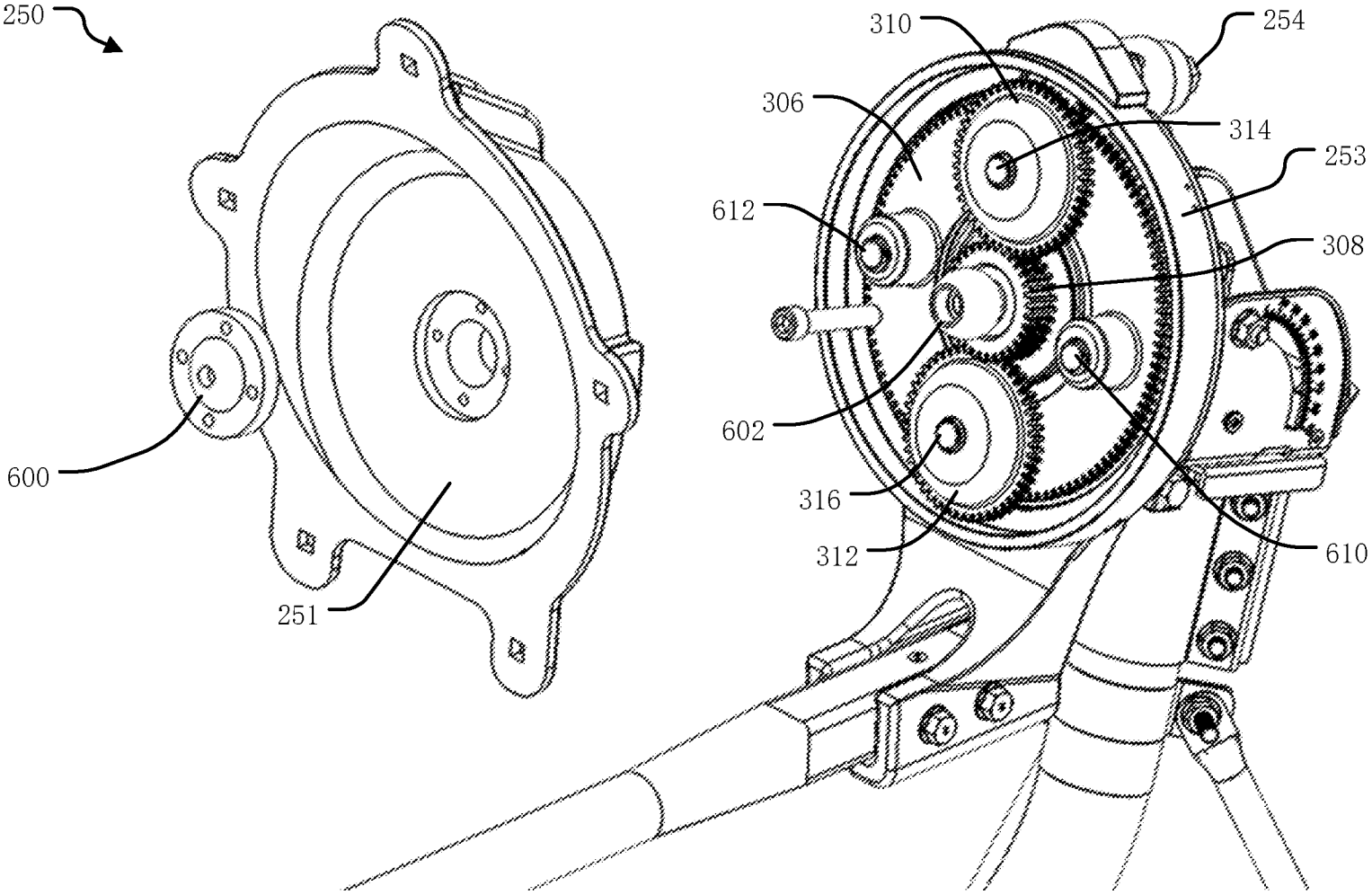
Figure 6C:
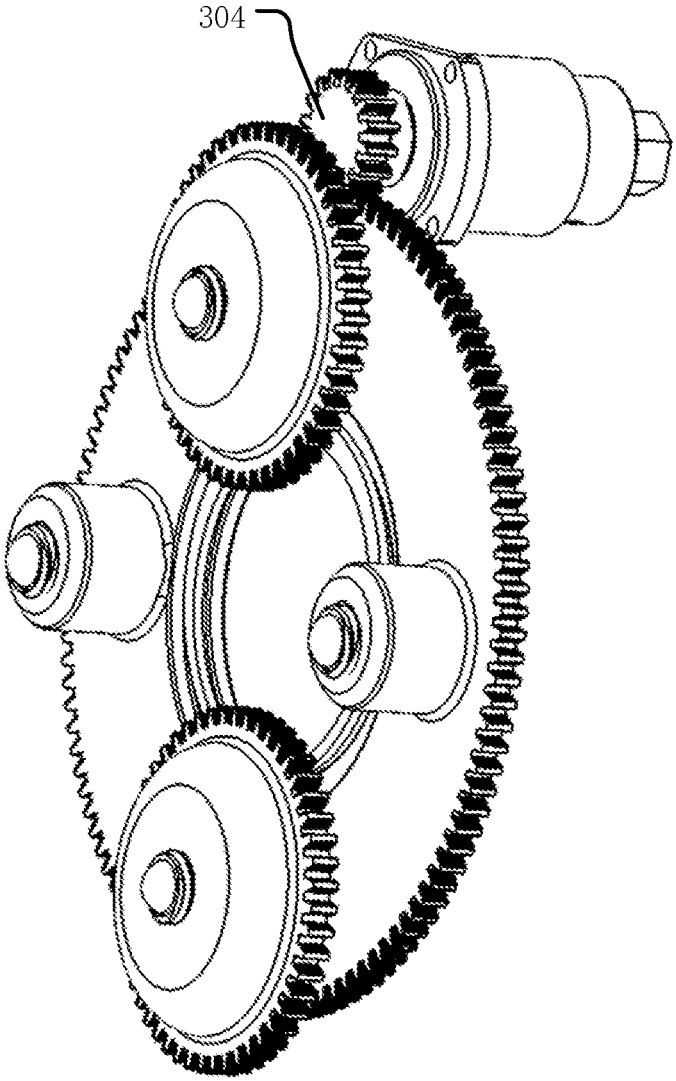

FIG. 6A illustrates a perspective view of a first example of tilt assembly 250. The tilt assembly includes tilt plate 251, multiple gears (partially viewable in FIG. 6), base plate 253 and single drive interface 254. In the illustrated embodiment, the tilt assembly 250 includes a ball interface 600 that is bolted to the reflector facing side of the tilt plate 251. FIG. 6B illustrates an exploded view of the example of tilt assembly 250 of FIG. 6A. In the illustrated embodiment of FIG. 6B, the tilt assembly 250 includes a ball 602 seated within the ball interface 600.

In the illustrated embodiment of FIGS. 6A-6B, the gears of the tilt assembly 250 are the same gears described above with respect to FIGS. 3 and 4A-4B. Thus, in the illustrated embodiment, the tilt assembly 250 includes ring gear 306, center gear 308, first planetary gear 310 and second planetary gear 312. The tilt assembly also includes drive gear 304, as can be seen in the illustrated partial view of FIG. 6C. As shown in FIG. 6B, the tilt assembly 250 includes first threaded rod 314 threaded within the first planetary gear 310 and second threaded rod 316 is threaded within the second planetary gear 312.

The illustrated embodiment also includes a first pivot rod 610 and a second pivot rod 612 attached the ring gear 306. Similar to the first and second threaded rods 314, 316, the first and second pivot rods 610, 612 contact the tilt plate 251 and move around the central axis of the ring gear 306 when the ring gear 306 rotates. However, unlike the first and second threaded rods 314, 316, the first and second pivot rods 610, 612 do not change length. Rather, the first and second pivot rods 610, 612 provide additional points of contact with the tilt plate 251, which may improve the stability by providing more contact points for tilting the tilt plate 251 about the pivot line (not shown) and improve reliability by reducing the amount of force that is applied at each contact point. The additional contact points may also improve the stability from conditions such as wind or other external forces applied to the reflector. The first and second pivot rods 610, 612 may also reduce the stresses within the first and second threaded rods 314, 316 when external forces are applied to the reflector. As shown in FIG. 6B, the pivot rods 610, 612 are on opposing sides of the center gear. As a result of the arrangement shown in FIG. 6B, the pivot line (not shown) intersects the pivot rods 610, 612.

Figure 6D:
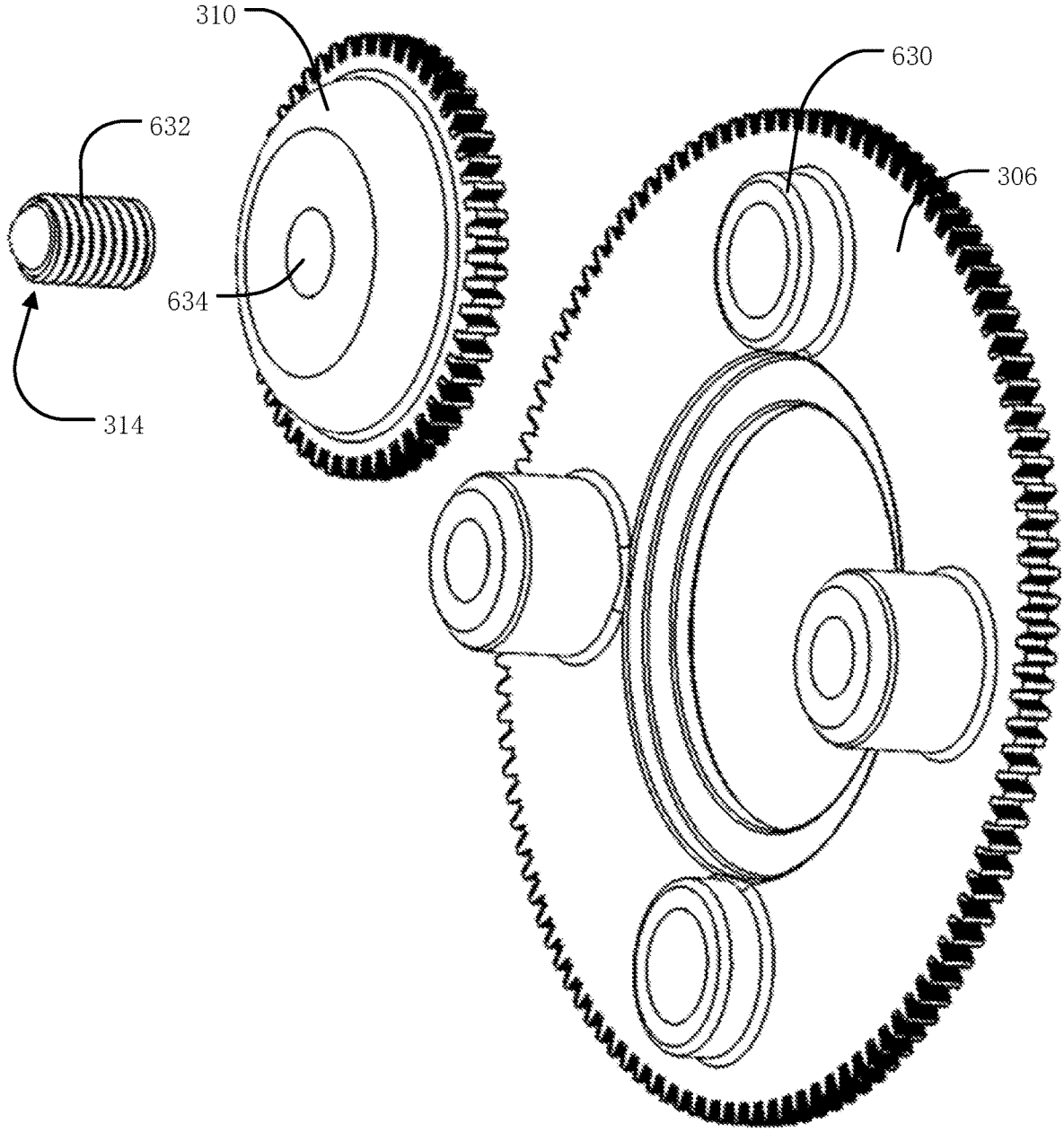

FIG. 6D illustrates an exploded view of a portion of the example of tilt assembly 250 shown in FIG. 6A. As shown in FIG. 6D, the threaded rod 314 includes threads 632 that engage threads (not shown) within opening 634 of planetary gear 310. As discussed above, the planetary gear 310 is meshed with center gear 308 (not shown in FIG. 6D) to cause the planetary gear 310 to rotate about its central axis when moving about the center axis of the ring gear 306. The rotation of the planetary gear 310 causes the threaded rod 314 to extend out of, or retract into, the opening 634, depending upon the direction of rotation. In the illustrated example of FIG. 6D, the planetary gear 310 is retained by and rotates about boss 630 on the ring gear 306.

Figure 7A:
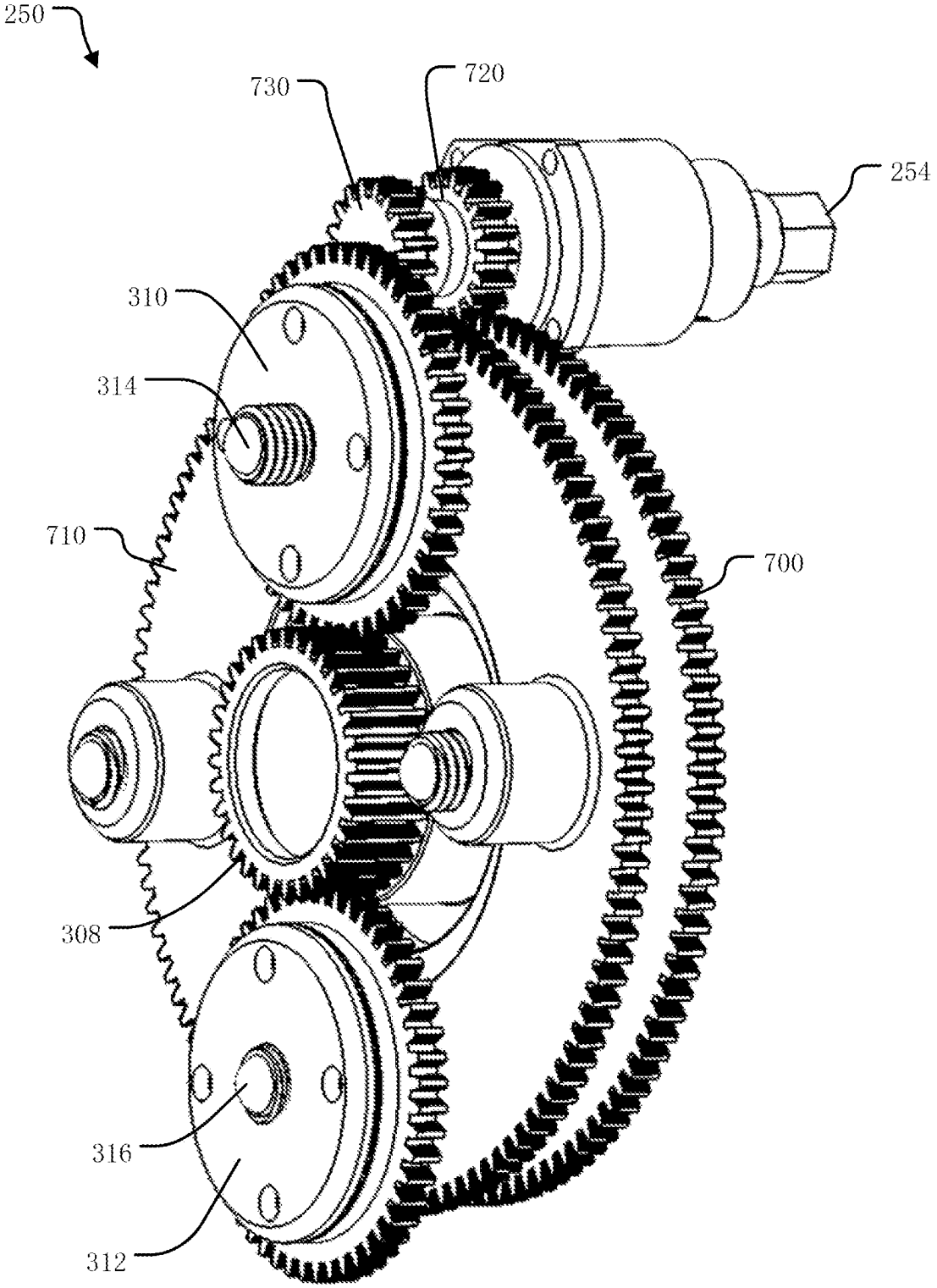
FIGS. 7A and 7B illustrate various views of a second example of a tilt assembly.
Figure 7B:
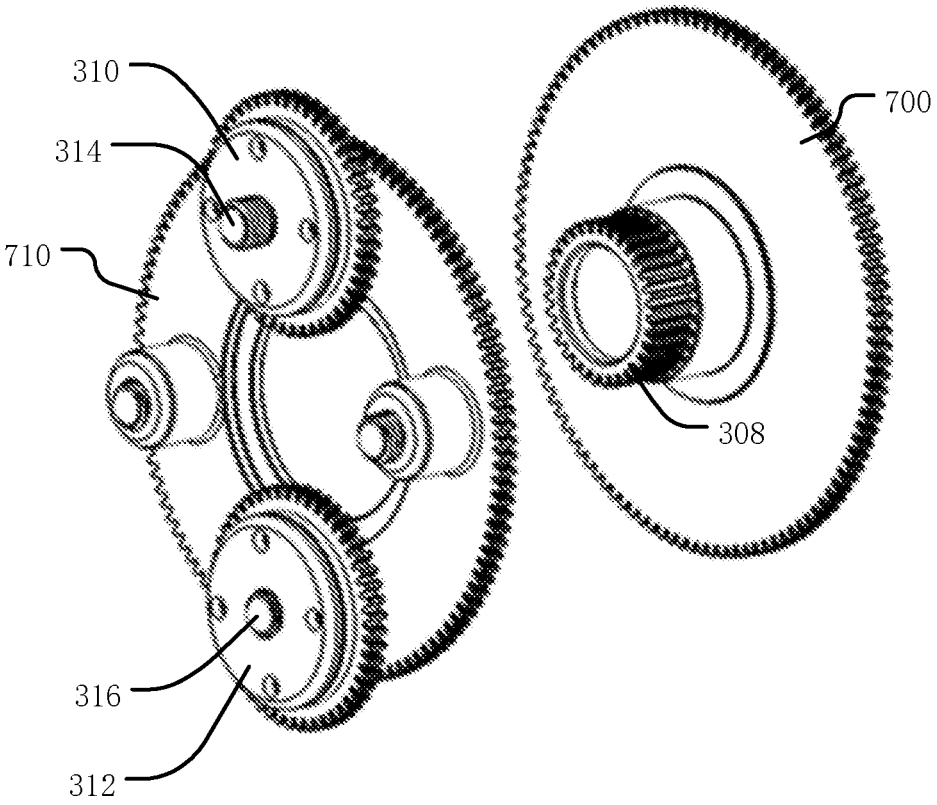

FIGS. 7A and 7B are perspective and exploded views of a second example of a tilt assembly 250. In the illustrated embodiment of FIGS. 7A and 7B, the tilt assembly 250 includes a first ring gear 700 and a second ring gear 710. The tilt assembly 250 of FIGS. 7A and 7B also includes a first drive gear 720 meshed with the first ring gear 700, and a second drive gear 730 meshed with the second ring gear 710. Center gear 308 extends through an opening in the second ring gear 710 and is attached to the first ring gear 700.

In response to a drive applied to the single drive interface 254, each of the drive gears 720, 730 will rotate and thus cause rotation of the ring gears 700, 710 respectively. However, in the illustrated embodiment first drive gear 720 has a larger diameter than the diameter of the second drive gear 730, and thus first ring gear 700 has a smaller diameter than the diameter of the second ring gear 710. As a result, for a given drive applied to the single drive interface 254 sufficient to cause full rotation (i.e. 360 degrees) of the second ring gear 710, the first ring gear 700 will undergo an angular rotation less than the full rotation (i.e., less than 360 degrees). By having the center gear 308 attached to the first ring gear 700, the distances the threaded rods 314, 316 extend and retract for a given drive applied to the single drive interface 254 can be smaller than if the center gear were attached to a base plate, as is the case in some embodiments described above. This in turn can allow for finer control over the tilt position of the tilt plate for a given drive applied to the single drive interface 254.

Figure 8:
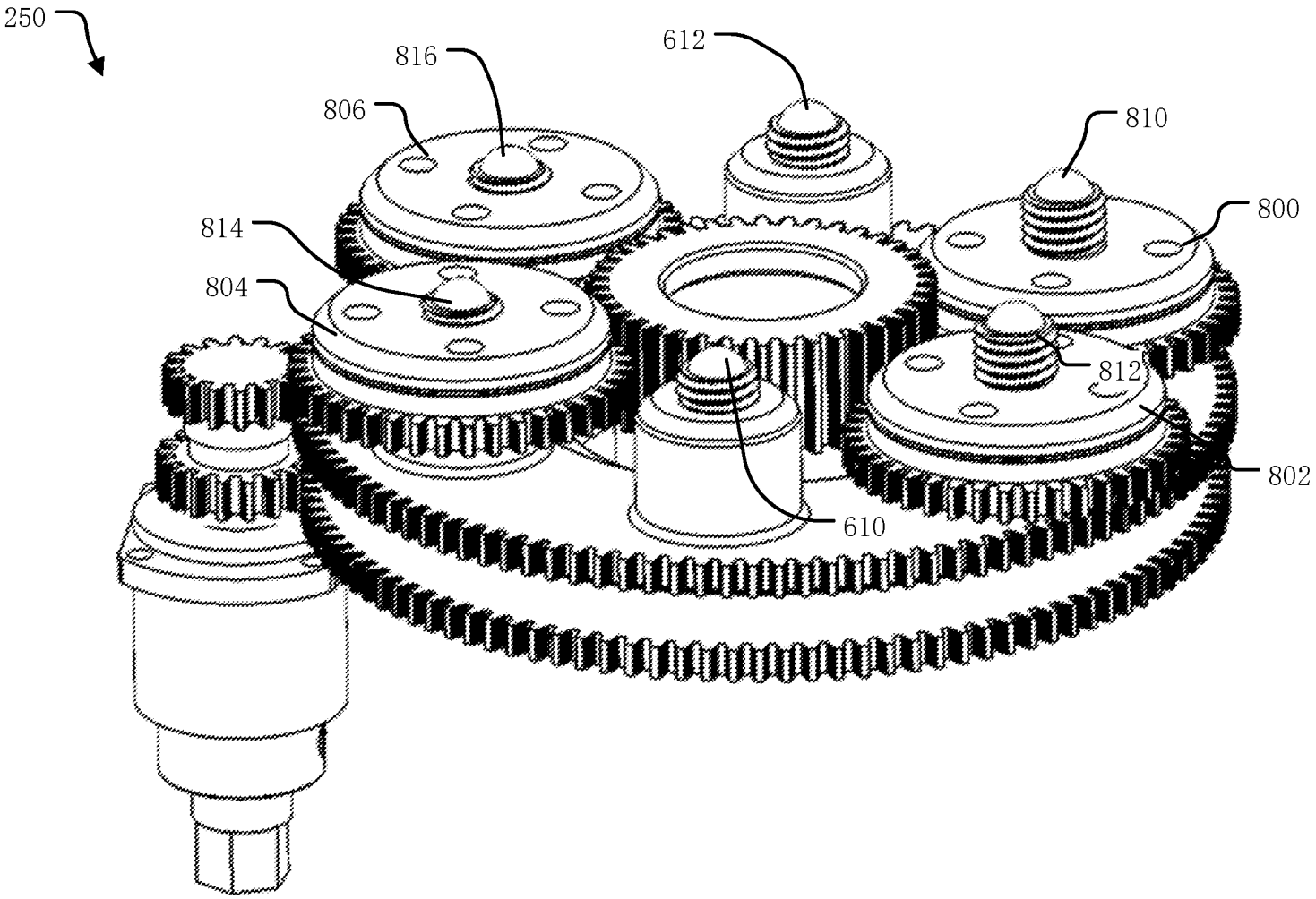
FIG. 8 illustrates a perspective view of a third example of a tilt assembly.

FIG. 8 illustrates a perspective view of a third example of a tilt assembly 250. In the illustrated example of FIG. 8, the tilt assembly 250 is similar to that illustrated in FIGS. 7A-7B, but includes four planetary gears 800, 802, 804, 806 with four corresponding threaded rods 810, 812, 814, 816. Threaded rods 810, 812 have the same thread type (e.g., right-hand threads) and thus move up or down together. Threaded rods 814, 816, have a thread type (e.g., left-hand threads) opposite that of the threaded rods 810, 812, and thus move together in the opposite direction of the threaded rods 810, 812.

Figure 9A:
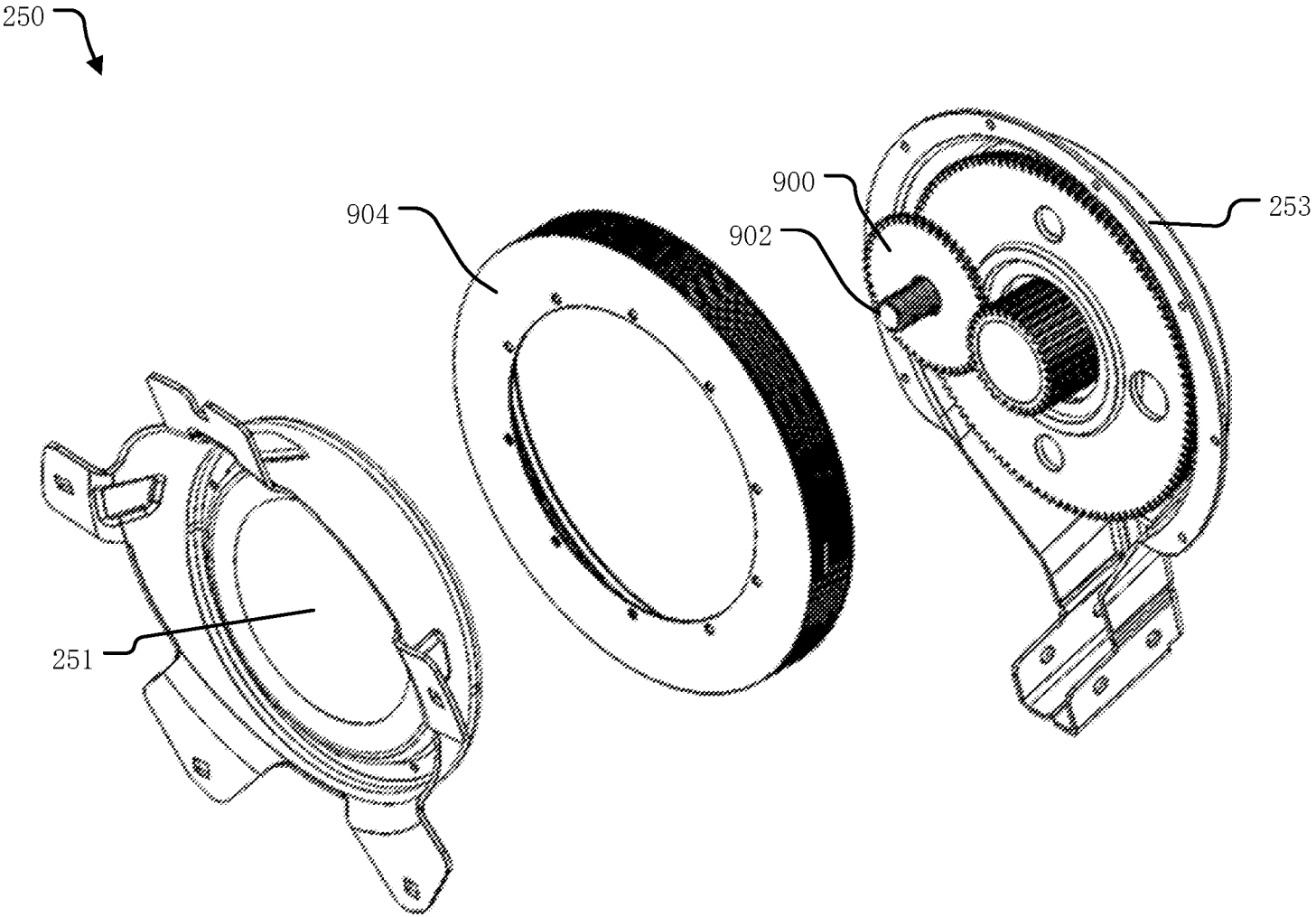
FIGS. 9A and 9B illustrate various views of a fourth example of a tilt assembly.
Figure 9B:
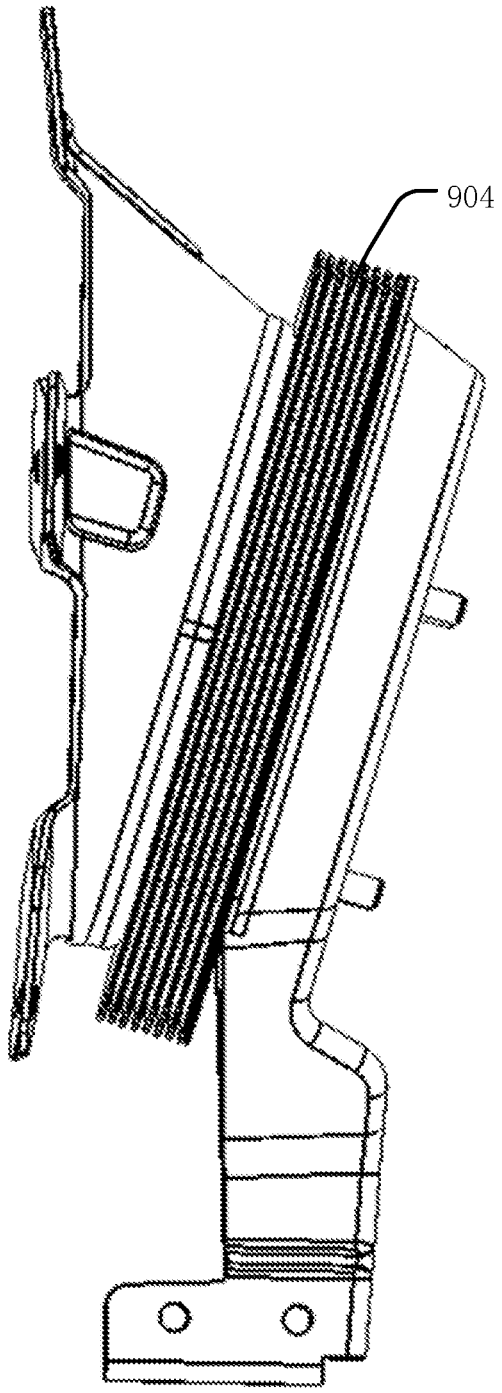

FIGS. 9A and 9B illustrate exploded and side views of a fourth example of a tilt assembly 250. In contrast to the tilt assembly of FIGS. 6A-6D, the illustrated example of FIGS. 9A-9B has a single planetary gear 900 and a single threaded rod 902. In the illustrated example of FIGS. 9A-9B, the flexible coupling of the tilt assembly 250 that precludes rotation of the tilt plate relative to the base plate is a diaphragm coupling 904 that extends between tilt plate 251 and the base plate 253. In the illustrated example, the diaphragm coupling 904 completely surrounds the interior space between the tilt plate 251 and the base plate 253. Alternatively, the diaphragm coupling 904 may be a partial diaphragm that only surrounds a portion of that interior space.

In embodiments described above, the techniques for self-peaking capability during installation, and remote re-alignment over time, are described in conjunction with tilt assembly 250. More generally, the techniques described herein may be used in conjunction with other types of mechanisms that provide self-peaking capability during installation and remote re-alignment over time.

While the present disclosure is described by reference to the examples detailed above, it is to be understood that these examples are intended in an illustrative rather than in a limiting sense. It is contemplated that modifications and combinations will readily occur to those skilled in the art, which modifications and combinations will be within the spirit of the disclosure and the scope of the following claims.

What is claimed is:

1. An antenna assembly comprising:

an antenna;

a mounting bracket assembly to align a beam of the antenna along a coarse alignment direction; and an antenna positioner coupled to the antenna and the mounting bracket assembly, the antenna positioner configured for scanning the beam of the antenna along a varying pattern in two dimensions relative to the coarse alignment direction in response to a drive force received via a single drive interface of the antenna positioner.

2. The antenna assembly of claim 1, wherein, for scanning the beam of the antenna, the antenna positioner is configured to:

change, in response to a driving of the single drive interface of the antenna positioner, an angle between a direction of the beam and an axis; and change, in response to the driving of the single drive interface of the antenna positioner, a direction of a projection of the beam on a plane that is perpendicular to the axis.

3. The antenna assembly of claim 1, wherein the antenna positioner is configured for scanning the beam of the antenna in an azimuth direction relative to the mounting bracket assembly and an elevation direction relative to the mounting bracket assembly using the single drive interface of the antenna positioner.

4. The antenna assembly of claim 1, wherein, for scanning the beam of the antenna, the antenna positioner is configured to move the beam of the antenna in a spiral pattern relative to the mounting bracket assembly in response to a driving of the single drive interface of the antenna positioner.

5. The antenna assembly of claim 1, wherein the antenna comprises a reflector and an antenna feed having a position that is fixed relative to the reflector, and the antenna positioner is configured to move the reflector and the antenna feed in response to a driving of the single drive interface.

6. The antenna assembly of claim 1, wherein the antenna comprises a reflector and an antenna feed, and the antenna positioner is configured to change a relative position between the reflector and the antenna feed in response to a driving of the single drive interface.

7. The antenna assembly of claim 1, wherein the antenna comprises a phased array, a slot array, or open ended waveguide array.

8. The antenna assembly of claim 1, further comprising:

a motor coupled with the single drive interface of the antenna positioner; and a controller operable to perform a pointing operation based at least in part on driving the motor.

9. The antenna assembly of claim 8, wherein the controller is operable to receive a command and perform the pointing operation based at least in part on the received command.

10. The antenna assembly of claim 8, wherein the controller is operable to perform the pointing operation according to a periodic interval.

11. The antenna assembly of claim 8, wherein the controller is operable to issue a notification for an operator to perform a coarse pointing operation of the antenna assembly based at least in part on a result of the pointing operation.

12. The antenna assembly of claim 8, wherein the controller is operable to:

measure a signal associated with the beam;

select a position of the motor based at least in part on the measured signal; and actuate the motor to the selected position.

13. A method of antenna pointing, the method comprising:

providing an antenna assembly comprising an antenna, a mounting bracket assembly to align a beam of the antenna along a coarse alignment direction, and an antenna positioner coupled to the antenna and the mounting bracket assembly, the antenna positioner configured for scanning the beam of the antenna along a varying pattern in two dimensions relative to the coarse alignment direction in response to a drive force received via a single drive interface of the antenna positioner; and scanning the beam of the antenna along the varying pattern in the two dimensions relative to the mounting bracket assembly by driving the single drive interface of the antenna positioner.

14. The method of claim 13, wherein the scanning the beam of the antenna comprises:

changing, in response to the driving the single drive interface of the antenna positioner, an angle between a direction of the beam and an axis; and changing, in response to the driving the single drive interface of the antenna positioner, a direction of a projection of the beam on a plane that is perpendicular to the axis.

15. The method of claim 13, wherein the scanning the beam of the antenna comprises:

scanning the beam in an azimuth direction relative to the mounting bracket assembly and an elevation direction relative to the mounting bracket assembly by driving the single drive interface of the antenna positioner.

16. The method of claim 13, further comprising:

receiving a command to perform a pointing operation, wherein scanning the beam of the antenna comprises controlling a motor for the driving the single drive interface of the antenna positioner based at least in part on receiving the command to perform the pointing operation.

17. The method of claim 13, further comprising:

performing a pointing operation, wherein the pointing operation comprises the scanning the beam of the antenna; and issuing a notification for an operator to perform a coarse pointing operation of the antenna assembly based at least in part on a result of performing the pointing operation.

18. The method of claim 13, further comprising:

initiating the scanning the beam of the antenna according to a periodic interval.

19. The method of claim 13, further comprising:

measuring a signal associated with the beam of the antenna based at least in part on the scanning the beam;

selecting a position of a motor based at least in part on the measured signal; and actuating the motor to orient the beam based at least in part on the selected position.

* * * * *